US012429219B2

(12) United States Patent
Sampath et al.

(10) Patent No.: US 12,429,219 B2
(45) Date of Patent: Sep. 30, 2025

(54) COMPONENTS FOR COMBUSTOR

(71) Applicant: General Electric Company, Schenectady, NY (US)

(72) Inventors: Karthikeyan Sampath, Bengaluru (IN); Rimple Rangrej, Bengaluru (IN); Pradeep Naik, Bengaluru (IN); Saket Singh, Bengaluru (IN); Deepak Ghiya, Bengaluru (IN); Perumallu Vukanti, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/314,418

(22) Filed: May 9, 2023

(65) Prior Publication Data

US 2024/0133552 A1 Apr. 25, 2024
US 2024/0230088 A9 Jul. 11, 2024

(30) Foreign Application Priority Data

Oct. 20, 2022 (IN) ..... 202211060010

(51) Int. Cl.
*F23R 3/00* (2006.01)
*F23R 3/60* (2006.01)

(52) U.S. Cl.
CPC ..... *F23R 3/002* (2013.01); *F23R 3/60* (2013.01); *F23R 2900/00014* (2013.01)

(58) Field of Classification Search
CPC ..... F05D 2260/96; F05D 2260/963; F05D 2260/964; F23R 3/002; F23R 3/425; F23R 3/44; F23R 3/46; F23R 3/50; F23R 3/52; F23R 3/54; F23R 3/56; F23R 3/58; F23R 3/60; F23R 2900/00014; F23R 2900/00015; F23R 2900/03342
See application file for complete search history.

(56) References Cited

U.S. PATENT DOCUMENTS 10,408,453 B2 9/2019 Mongillo et al.
10,527,284 B2 1/2020 Sobol et al.
10,634,350 B2 4/2020 Harding et al.
(Continued)

FOREIGN PATENT DOCUMENTS

EP 3431875 B1 12/2020
FR 2974162 B1 4/2018
(Continued)

*Primary Examiner* — Scott J Walthour
(74) *Attorney, Agent, or Firm* — Venable LLP; Griffin A. A. Deadwick; Michele V. Frank

(57) ABSTRACT

In one aspect, a combustor for a turbomachine engine includes a combustion chamber and a component in operable flow with the combustion chamber. The component has a porous structure that defines multiple channels, that are adapted to configure the component as a damper to reduce combustion dynamics of the combustor. In another aspect, a combustor of a turbomachine engine includes a diffuser, a combustor component positioned aft of the diffuser to receive cooling air therefrom, and a support structure in operable flow with the diffuser and the combustor component and positioned therebetween. The support structure has a porous structure that defines multiple channels, which are adapted to improve a backflow margin of the cooling air by reducing turbulence of the cooling air.

20 Claims, 16 Drawing Sheets

(56) References Cited

U.S. PATENT DOCUMENTS

| | | | | |
|---|---|---|---|---|
| 11,137,140 | B2 | 10/2021 | Mongillo, Jr. et al. | |
| 2012/0167574 | A1* | 7/2012 | Uskert | F23M 20/005 60/754 |
| 2015/0330635 | A1* | 11/2015 | Pidcock | F23R 3/286 60/748 |
| 2018/0347468 | A1 | 12/2018 | Caimano et al. | |

FOREIGN PATENT DOCUMENTS

| | | | | |
|---|---|---|---|---|
| FR | 3050229 | B1 | 4/2018 | |
| GB | 2515028 | A * | 12/2014 | F23R 3/002 |

* cited by examiner

COMPONENTS FOR COMBUSTOR

CROSS REFERENCE TO RELATED APPLICATIONS

The present application claims the benefit of Indian Patent Application No. 202211060010, filed on Oct. 20, 2022, which is hereby incorporated by reference herein in its entirety.

TECHNICAL FIELD

The present disclosure relates to combustors of turbomachine engines. More specifically, the present disclosure relates to porous components of combustors.

BACKGROUND

Combustors in turbomachine engines receive a mixture of fuel and highly compressed air, which is ignited to produce hot combustion gases. These hot gases are used to provide a torque in a turbine to provide mechanical power and thrust. Continuing demands for increased engine performance (e.g., higher cycle overall pressure ratio) and fuel efficiency (e.g., lower specific fuel consumption) pose a contradicting challenge to meet environmental requirements for acoustic noise and emissions, versus economic requirements for longer combustor component life cycles.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, or structurally similar elements.

DETAILED DESCRIPTION

Figure 1:
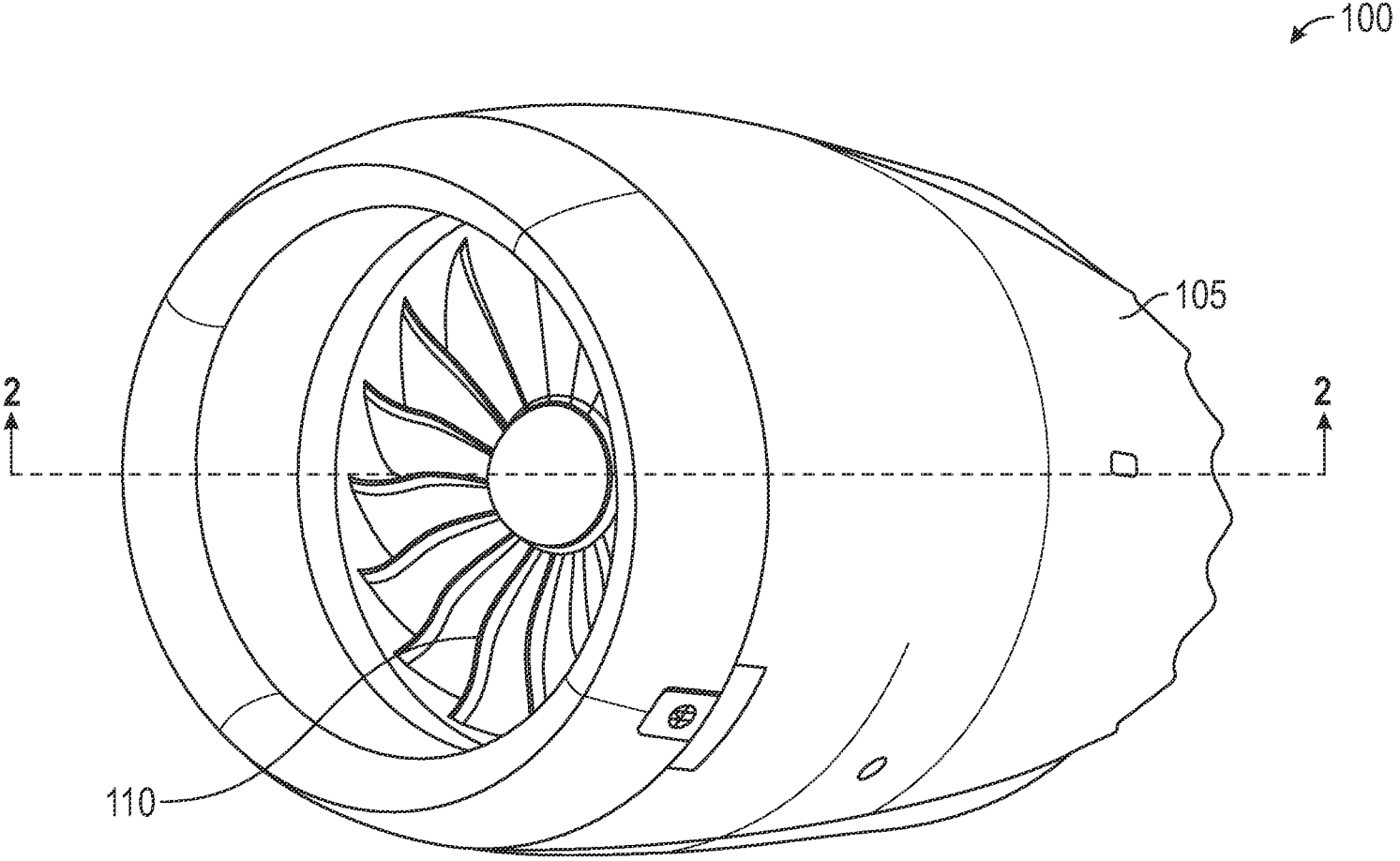
FIG. 1 shows an example of a turbomachine engine, according to aspects of the present disclosure.

Features, advantages, and embodiments of the present disclosure are set forth or apparent from a consideration of the following detailed description, drawings, and claims. Moreover, the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first," "second," and "third" may be used interchangeably to distinguish one component from another and are not intended to signify location or importance of the individual components. As used herein, the terms "set," a "set" of, or a "plurality" of elements can be any number of elements, including only one.

The terms "fore" (or "forward") and "aft" refer to relative positions within a gas turbine engine or vehicle, and refer to the normal operational attitude of the gas turbine engine or the vehicle. For example, with regard to a gas turbine engine, forward refers to a position closer to an engine inlet and aft refers to a position closer to an engine nozzle or exhaust.

The terms "outer" and "inner" refer to relative positions within a turbomachine engine, from a centerline axis of the engine. For example, outer refers to a position farther from the centerline axis and inner refers to a position closer to the centerline axis.

The terms "coupled," "fixed," "attached to," and the like, refer to both direct coupling, fixing, or attaching, as well as indirect coupling, fixing, or attaching through one or more intermediate components or features, unless otherwise specified herein.

The singular forms "a," "an," and "the" include plural references unless the context clearly dictates otherwise.

The terms "low" and "high," or their respective comparative degrees (e.g., "lower" and "higher," where applicable), when used with the compressor, turbine, shaft, or spool components, each refers to relative pressures or relative speeds within an engine unless otherwise specified. For example, a "low-speed shaft" defines a component configured to operate at a rotational speed, such as a maximum allowable rotational speed, which is lower than that of a "high-speed shaft" of the engine. Alternatively, unless otherwise specified, these terms may be understood in their superlative degree. For example, a "low-pressure turbine" may refer to the lowest maximum pressure within a turbine section, and a "high-pressure turbine" may refer to the highest maximum pressure within the turbine section. The terms "low" or "high" may additionally, or alternatively, be understood to be relative to minimum allowable speeds or pressures, or minimum allowable speeds or maximum allowable speeds or pressures relative to, for example, normal, desired, steady state, operation.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

The term "combustion dynamics" refers to oscillatory instabilities that arise during operation of the combustor, that reduce the performance and efficiency of the combustion process, or degrade the structural integrity of the combustor itself. Without damping, the amplitude of these instabilities may grow exponentially over time. In some embodiments, combustion dynamics may include, but are not limited to, mechanical vibrations, thermoacoustic instabilities and hydrodynamic instabilities.

The term "thermoacoustic instabilities" (also called "combustion instabilities" or "acoustic instabilities"), refers to undesirable large-amplitude pressure, temperature, and density oscillations of the air and hot gas within the combustion chamber. These oscillations are well-known by persons of ordinary skill in the art to be caused by coupling between unsteady heat release from the combustion process, and the natural acoustic modes of the combustion system. In other words, thermoacoustic instabilities occur when energy liberated from heat release is converted to acoustic oscillations at resonance frequencies of the combustion device.

The term "hydrodynamic instabilities" refers to turbulence within the fuel and air mixture inside the combustion chamber. The turbulence may be caused by velocity shear within the fuel-air mixture, within the hot combustion gas byproducts, or across the complex interface therebetween. This turbulence causes uneven mixing of fuel and air, instability and oscillations in the combustion flame, and uneven heat release from the combustion process.

The term "porosity" (also referred to as "volume fraction") refers to a ratio of the volume of void within a structure to the volume of solid. A porosity of zero (or, equivalently, 0%) therefore would be a solid structure and a porosity of one (or, equivalently, 100%) would be a fully hollow structure.

The term "backflow margin" (BFM) is defined as the difference between the pressure of a coolant inside an engine component and the local pressure of the combustion gases outside the engine component. The engine component may be a component of a turbine (e.g., an airfoil) or a component of a combustor (e.g., a liner of the combustion chamber). Sufficient BFM must be maintained to prevent ingestion of the hot combustion gases into the engine component to be cooled, and to ensure continuous discharge of the coolant through the component (e.g., through cooling holes, also referred to as dilution holes). An adequate BFM limits leakage of hot gases flowing along the gas path, which leads to a reduction in output from the gas turbine system and may cause damage to secondary flow/cooling components resulting from hot gas ingestion.

One or more components of the turbomachine engine described below may be manufactured or formed using any suitable process, such as an additive manufacturing process, such as a three-dimensional (3D) printing process. The use of such a process may allow such a component to be formed integrally, as a single monolithic component, or as any suitable number of sub-components. In particular, the additive manufacturing process may allow such a component to be integrally formed and include a variety of features not possible when using prior manufacturing methods. For example, the additive manufacturing methods described herein enable the manufacture of combustor cowls having unique features, configurations, thicknesses, materials, densities, passageways, headers, and mounting structures that may not have been possible or practical using prior manufacturing methods. Some of these features are described below.

This disclosure and various embodiments relate to a turbomachine engine, also referred to as a gas turbine engine, a turboprop engine, or a turbomachine. These turbomachine engines can be applied across various technologies and industries. Various embodiments may be described herein in the context of aeronautical engines and aircraft machinery.

In some aspects of the present disclosure, a turbomachine engine is configured as a direct drive engine. In other aspects of the present disclosure, a turbomachine engine can be configured as a geared engine with a gearbox.

In some aspects of the present disclosure, a propulsor of a turbomachine engine can be a fan encased within a fan case or a nacelle. This type of turbomachine engine can be referred to as "a ducted engine." In other aspects of the present disclosure, a propulsor of a turbomachine engine can be exposed (e.g., not within a fan case or a nacelle). This type of turbomachine engine can be referred to as "an open rotor engine" or an "unducted engine."

FIG. 1 shows an example of a turbomachine engine 100, according to an embodiment of the present disclosure. Types of such engines in various embodiments include but are not limited to turboprops, turbofans, turbomachines, and turbojets. In the example of FIG. 1, the turbomachine engine 100 is a ducted engine covered by a protective cowl 105, so that the only component visible in this exterior view is a fan assembly 110. A nozzle, not visible in FIG. 1, also protrudes from the aft end of the turbomachine engine 100 beyond the protective cowl 105.

Figure 2:
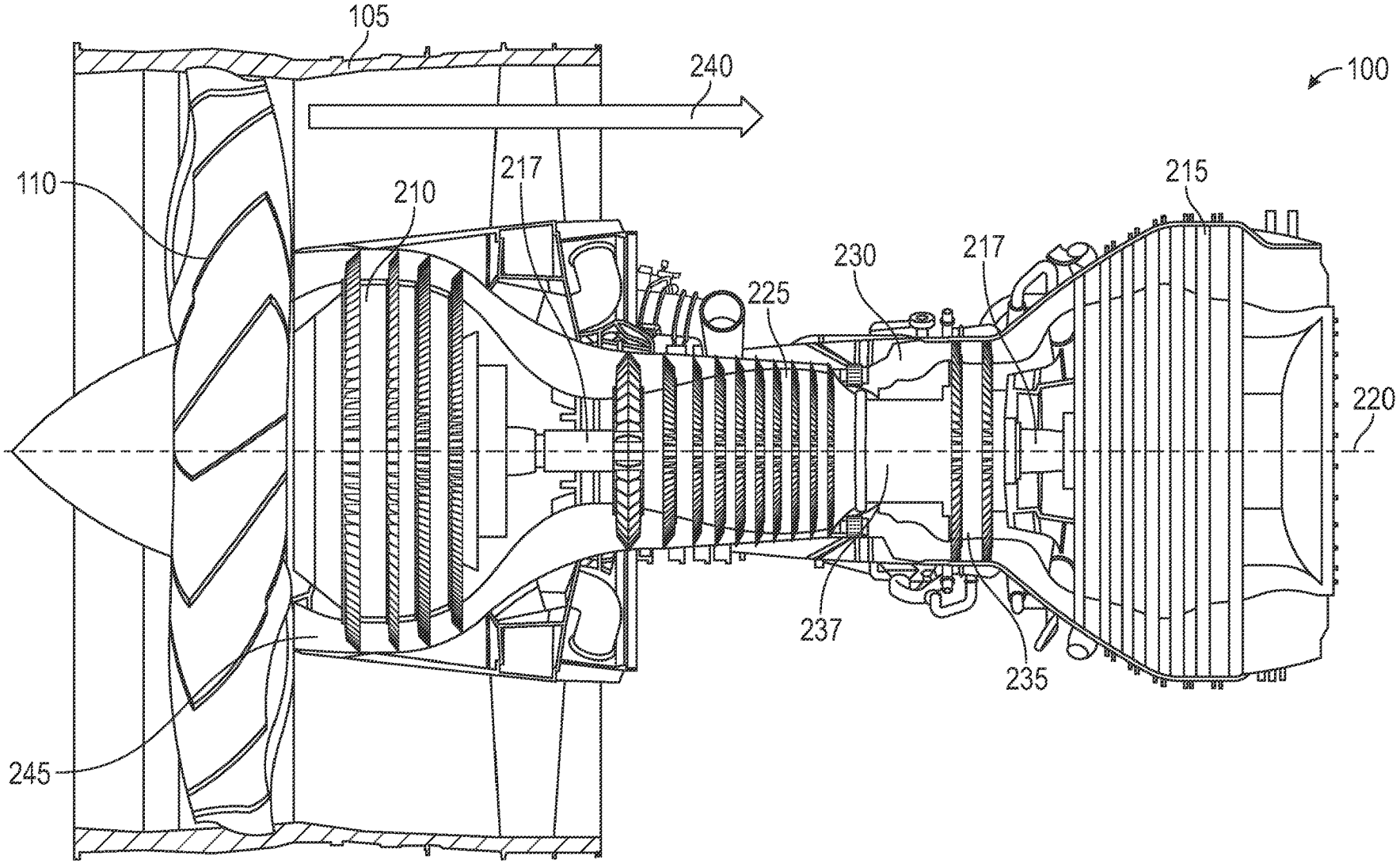
FIG. 2 shows a schematic, cross-sectional view taken along line 2-2 of the turbomachine engine shown in FIG. 1, according to aspects of the present disclosure.

FIG. 2 shows a schematic, cross-sectional view taken along line 2-2 of the turbomachine engine 100 shown in FIG. 1, according to aspects of the present disclosure. In this example, the turbomachine engine 100 is a two-spool turbomachine that includes a high-speed system and a low-speed system, both of which are fully covered by the protective cowl 105. The low-speed system of the turbomachine engine 100 includes the fan assembly 110, a low-pressure compressor 210 (also referred to as a booster), and a low-pressure turbine 215, all of which are coupled to a low-pressure shaft 217 (also referred to as the low-pressure spool) that extends between the low-speed system components along the centerline axis 220 of the turbomachine engine 100. The low-pressure shaft 217 enables the fan assembly 110, the low-pressure compressor 210, and the low-pressure turbine 215 to rotate in unison about the centerline axis 220.

The high-speed system of the turbomachine engine 100 includes a high-pressure compressor 225, a combustor 230, and a high-pressure turbine 235, all of which are coupled to a high-pressure shaft 237 that extends between the high-speed system components along the centerline axis 220 of the turbomachine engine 100. The high-pressure shaft 237 enables the high-pressure compressor 225 and the high-pressure turbine 235 to rotate in unison about the centerline axis 220, at a different rotational speed than the rotation of the low-pressure components (and, in some embodiments, at a higher rotational speed, or a counter-rotating direction, relative to the low-pressure system).

The components of the low-pressure system and the high-pressure system are positioned so that a portion of the air taken in by the turbomachine engine 100 flows through the turbomachine engine 100 in a flow path from fore to aft through the fan assembly 110, the low-pressure compressor 210, the high-pressure compressor 225, the combustor 230, the high-pressure turbine 235, and the low-pressure turbine 215. Another portion of the air intake by the turbomachine engine 100 bypasses the low-pressure system and the high-pressure system, and flows from fore to aft as shown by arrow 240.

The portion of air entering the flow path of the turbomachine engine 100 is supplied from an inlet 245. For the embodiment shown in FIG. 2, the inlet 245 has an annular or an axisymmetric three hundred sixty-degree configuration, and provides a path for incoming atmospheric air to enter the turbomachinery flow path, as described above. Such a location may be advantageous for a variety of reasons, including management of icing performance as well as protecting the inlet 245 from various objects and materials as may be encountered in operation. In other embodiments, however, the inlet 245 may be positioned at any other suitable location, e.g., arranged in a non-axisymmetric configuration.

The combustor 230 is located between the high-pressure compressor 225 and the high-pressure turbine 235. The combustor 230 can include one or more configurations for receiving a mixture of fuel from a fuel system (not shown in FIG. 2) and air from the high-pressure compressor 225. This mixture is ignited by an ignition system (not shown in FIG. 2), creating hot combustion gases that flow from fore to aft through the high-pressure turbine 235, which provides a torque to rotate the high-pressure shaft 237 and, thereby, to rotate the high-pressure compressor 225. After exiting the high-pressure turbine, the combustion gases continue to flow from fore to aft through the low-pressure turbine 215, which provides a torque to rotate the low-pressure shaft 217 and, thereby, to rotate the low-pressure compressor 210 and the fan assembly 110.

In another sense, the forward stages of the turbomachine engine 100, namely, the fan assembly 110, the low-pressure compressor 210, and the high-pressure compressor 225, all prepare the intake air for ignition. The forward stages all require power in order to rotate. The rear stages of the turbomachine engine 100, namely, the combustor 230, the high-pressure turbine 235, and the low-pressure turbine 215, provide that requisite power, by igniting the compressed air and using the resulting hot combustion gases to rotate the low-pressure shaft 217 and the high-pressure shaft 237 (also referred to as rotors). In this manner, the rear stages use air to physically drive the front stages, and the front stages are driven to provide air to the rear stages.

As the exhaust gas exits out of the aft end of the rear stages, the exhaust gas reaches the nozzle at the aft end of the turbomachine engine 100 (not shown in FIG. 2). When the exhaust gases pass over the nozzle, and combine with the bypassed air that is also being driven by the fan assembly 110, an exhaust force is created that is the thrust generated by the turbomachine engine 100. This thrust propels the turbomachine engine 100, and, for example, an aircraft to which the turbomachine engine 100 may be mounted, in the forward direction.

As in the embodiment shown in FIG. 2, the fan assembly 110 is located forward of the low-pressure turbine 215 in a "puller" configuration, and the exhaust nozzle is located aft. As is depicted, the fan assembly 110 is driven by the low-pressure turbine 215, and, more specifically, is driven by the low-pressure shaft 217. More specifically, the turbomachine engine 100 in the embodiment shown in FIG. 2 includes a power gearbox (not shown in FIG. 2), and the fan assembly 110 is driven by the low-pressure shaft 217 across the power gearbox. The power gearbox may include a gearset for decreasing a rotational speed of the low-pressure shaft 217 relative to the low-pressure turbine 215, such that the fan assembly 110 may rotate at a slower rotational speed than does the low-pressure shaft 217. Other configurations are possible and contemplated within the scope of the present disclosure, such as what may be termed a "pusher" configuration embodiment in which the low-pressure turbine 215 is located forward of the fan assembly 110.

The turbomachine engine 100 depicted in FIGS. 1 and 2 is by way of example only. In other embodiments, the turbomachine engine 100 may have any other suitable configuration, including, for example, any other suitable number of shafts or spools, fan blades, turbines, compressors, etc., and the power gearbox may have any suitable configuration, including, for example, a star gear configuration, a planet gear configuration, a single-stage, a multi-stage, epicyclic, non-epicyclic, etc. The fan assembly 110 may be any suitable fixed-pitched assembly or variable-pitched assembly. The turbomachine engine 100 may include additional components not shown in FIGS. 1 and 2, such as vane assemblies or guide vanes, etc.

Figure 3:
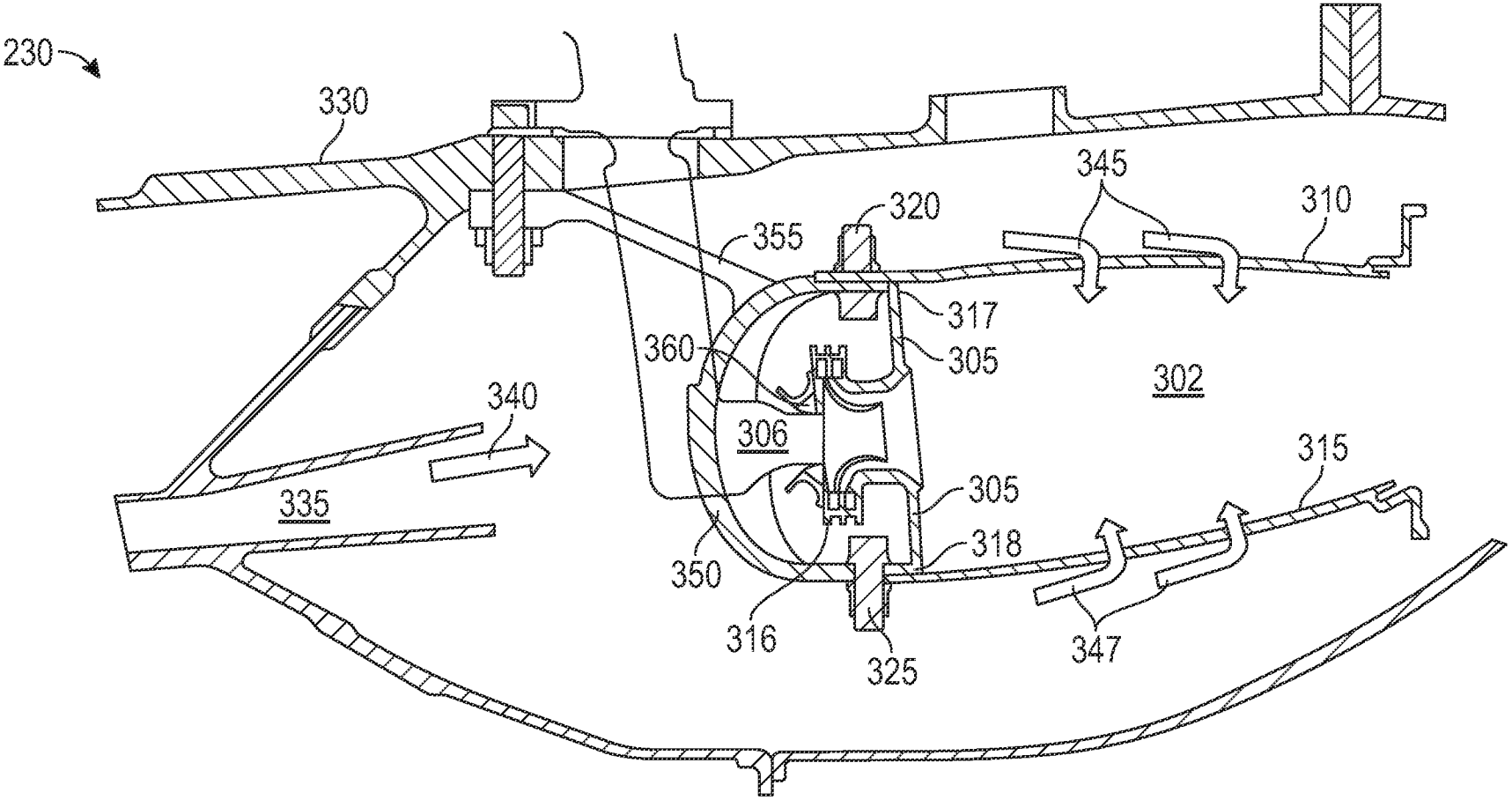
FIG. 3 shows a schematic view of a combustor, according to aspects of the present disclosure.

FIG. 3 shows a schematic view of the combustor 230, according to aspects of the present disclosure. The combustion chamber 302 of the combustor 230 is an annular open space with axial symmetry around the centerline axis 220 (FIG. 2). The combustion chamber 302 is bounded at the forward end by a dome 305. The combustor 230 also has an annular array of fuel nozzles 306 spaced along the circumference (also referred to as the circumferential direction) and facing in the aft direction. The dome 305 supports and positions each fuel nozzle 306, as well as an outer liner 310 and an inner liner 315 on the outer and inner annular surfaces, respectively. The outer liner 310 and the inner liner 315 are coaxial cylindrical surfaces around the centerline axis 220, the outer liner 310 being spaced radially outward from the inner liner 315.

Compressed air from the front stages of the turbomachine engine 100 flows into the combustor 230 and mixes in the combustion chamber 302 with fuel from the fuel nozzles 306. Each fuel nozzle 306 delivers fuel into a separate region (referred to as a cup) of the total annular volume of the combustion chamber 302, in accordance with a desired performance of the combustor 230 at various engine operating states. The air enters the combustion chamber 302 from swirlers 316 that surround each fuel nozzle 306, as well as through cooling holes (not shown in FIG. 3) in the inner liner 315 and the outer liner 310. The fuel-air mixture is ignited in the combustion chamber 302 to produce a steady flow of combustion gases that enter the turbines in the rear stages.

The dome 305 is oriented perpendicular to the central axes of the swirlers 316, and is symmetric around the centerline axis 220, with openings spaced along the circumference to receive each fuel nozzle 306. Because of its proximity to the combustion chamber, hot gases, and the extreme temperatures produced therein, the dome 305 must be configured to withstand a harsh environment. The combustion chamber 302 is open in the aft direction, to allow combustion gases to flow towards the high-pressure turbine 235 (FIG. 2).

The outer liner 310 and the inner liner 315 have a cylindrical shape about the centerline axis 220 (FIG. 2), the outer liner 310 having a radius greater than that of the inner liner 315. Both the outer liner 310 and the inner liner 315 extend in the aft direction along the centerline axis 220, with cooling holes along their surface to allow additional air from the high-pressure compressor 225 (FIG. 2) to mix with the fuel in the combustion chamber 302. Each liner has a cold side, which is the surface outside the combustion chamber 302 through which air enters the cooling holes, and a hot side, which is the surface inside the combustion chamber 302 through which air exits the cooling holes.

In the example of FIG. 3, the dome 305, the outer liner 310, and the inner liner 315 are all made of metal, though in some embodiments at least portions of the outer liner 310 and the inner liner 315 may alternatively be made of ceramic matrix composite materials. The liners may include integrally joined portions that are mechanically joined using an overlapping portion according to one embodiment. In other embodiments, the liners are formed in an additive manufacturing process as one unitary body.

The dome 305 and the outer liner 310 are coupled together at an outer wall 317 of the dome 305, and the dome 305 and the inner liner 315 are coupled together at an inner wall 318 of the dome 305 with arrays 320, 325 of fasteners. The fasteners in the arrays 320, 325 may include one or more of pins, bolts, nuts, nut plates, screws, and any other suitable types of fasteners. The arrays 320, 325 also serve to couple the dome 305, the outer liner 310, and the inner liner 315 to a support structure 330 of the combustor 230.

The support structure 330 defines a diffuser 335, which is an inlet for compressed air to flow from the high-pressure compressor 225 (FIG. 2), from fore to aft as shown by arrow 340, and into the combustion chamber 302 through the swirler 316 positioned around the fuel nozzle 306. The air also flows into the combustion chamber 302 through dilution holes (not shown in FIG. 3) in the outer liner 310 (e.g., along arrows 345) and through dilution holes (not shown in FIG. 3) in the inner liner 315 (e.g., along arrows 347). In addition, one or more heat shields or deflectors (not shown in FIG. 3) may also be provided on the dome 305 to help to protect the dome 305 from the heat of the combustion gases.

In addition, the support structure 330 supports the dome 305 with a cowl 350, the cowl 350 being connected to the support structure 330 by a mounting arm 355. The cowl 350 has an annular shape that is symmetric about the centerline axis 220, an aft-facing channel to receive the dome 305, and a forward-facing aperture to receive the fuel nozzle 306. The cowl 350 may be a single piece design, as shown in FIG. 3, having multiple openings around the circumference to receive each fuel nozzle 306. Alternatively, the cowl 350 may be a two-piece design or a split-cowl design, with an inner cowl (not shown in FIG. 3) and an outer cowl (not shown in FIG. 3), each having an annular shape that is symmetric about the centerline axis 220, and positioned to define a gap between them through which each fuel nozzle 306 may extend towards the combustion chamber 302.

The cowl 350 is coupled directly to the outer wall 317 and the inner wall 318 of the dome 305 by the arrays 320, 325 of fasteners. The cowl 350 may distribute the airflow aerodynamically between the dome 305 and the swirler 316, and around the inner liner 315 and the outer liner 310 surrounding the combustion chamber 302. A ferrule 360 is used to center the fuel nozzle 306 with the swirler 316. Other suitable structural configurations are contemplated.

A cooling fluid such as air is provided to the turbine vanes, blades, and shrouds to maintain the temperatures of those components at appropriate levels to ensure a satisfactory useful life of the components. In some embodiments, cooling may be accomplished by extracting a portion of the compressed air from the low-pressure compressor 210 and conducting that air to the high-pressure turbine 235. Any air compressed in the low-pressure compressor 210 and not used in generating combustion gases will reduce the efficiency of the engine. Therefore, the amount of cooling air bled from the low-pressure compressor 210 should be reduced. Furthermore, the air used for cooling turbine components typically discharges from orifices or gaps in those components. That cooling air mixes with the combustion gases in the turbine and will also reduce engine efficiency for thermodynamic and aerodynamic reasons. Accordingly, while turbine efficiency increases as turbine inlet temperature increases, that increase in temperature also requires effective cooling of the heated components, and such cooling is effected in a manner so as not to forfeit the increased efficiency realized by the increased temperature. Furthermore, the cooling air must be provided at suitable pressures and flow rates to not only adequately cool the turbine component(s), but to maintain an acceptable backflow margin (BFM).

During engine or combustion operations, the air flowing through the combustor 230 may generate combustion dynamics in the combustion chamber 302, including but not limited to mechanical vibration, thermoacoustic instabilities, and hydrodynamic instabilities, due to the flow therethrough. These instabilities are naturally occurring at one or more specific frequencies based on the dimensions and the flow through the combustor 230. These instabilities may generate large-amplitude fluctuations or oscillations of temperature and pressure—e.g., pressure waves, characterized by an oscillation frequency—that may reduce efficiency and durability in the combustor or components thereof. For example, the pressure waves could lead to flow fluctuations and heat release fluctuations within the combustor. Therefore, dampening, reducing, negating, limiting, or otherwise eliminating the effects of combustion dynamics is desirable.

In some embodiments of the present disclosure, components of the combustor may be configured as a damper to reduce or to eliminate the effects of combustion dynamics in the combustion chamber 302. The damper may be designed to match the frequency of the instabilities to operably suppress, to reduce, or to eliminate the effects of hydrodynamic instabilities, thermoacoustic instabilities, or mechanical vibrations arising in the combustion chamber 302. That is, the damper may be designed to target a specific frequency of instability within the combustion chamber 302 and to counteract the effects of that instability. The damper counteracts these effects by increasing viscous dissipation (also referred to as viscous loss), thermal dissipation, and mechanical energy absorption of pressure waves caused by the instabilities in the combustion chamber 302. In other words, the porous structure dissipates some of the acoustic energy created by undesirable combustion dynamics. Examples of such components that may be configured as dampers according to preferred embodiments include, but are not limited to, the dome 305, the cowl 350, the outer liner 310, the inner liner 315, the ferrule 360, the swirler 316, or a combination thereof.

In some embodiments of the present disclosure, the combustor component is configured as a damper by designing (e.g., during manufacture or refit) at least a portion of the component to have a porous structure that reduces the effects of combustion dynamics upon the combustor, compared to a combustor without the porous structure. In some embodiments, the porous structure of the combustor component defines multiple channels, each of the channels being characterized by multiple parameters. These parameters can include, but are not limited to width, length, wall thickness, shape, curvature, cross section, or a combination thereof. For example, the shape of the channel may be linear, curved, or serpentine, and the cross section of the channel may be circular, elliptical, square, rectangular, hexagonal, triangular, or gyroid. The porous structure is designed in some embodiments to have a porosity that is greater than zero and less than one. For example, in preferred embodiments, the porous structure is designed to have a porosity between thirty percent and eighty percent.

The porous combustor components of some embodiments have small channels (equivalently referred to as cells) along the path of incoming pressure waves from the combustor. As the pressure wave passes through these channels, the air inside the channels is compressed. The temperature of the air inside the channels increases as the pressure wave propagates through the porous structure. The heat that is generated within the air column inside the channels is radiated to the outside air. As the pressure wave passes from one channel to another, the pressure wave keeps losing energy by increasing viscous dissipation (also referred to as viscous loss), thermal dissipation, and mechanical energy absorption. The internal structures can be manufactured or printed in such a way that a broad range of frequencies of combustion dynamics can be addressed, or tailored for reduction.

Some advantages of using porous combustor components include improving the durability of the combustor 230. The simple and compact design also provides for a low cost of implementation, repairability and serviceability, and is easier to retrofit to existing engines. The porous components (e.g., the cowl 350 or the ferrule 360) may be made using additive manufacturing techniques, ceramic matrix composite materials, or thinner sheet metal or metal alloys, to have the same strength as solid component designs, resulting in a neutral weight addition or a marginally heavier weight addition.

In some embodiments, the porous structure of the combustor may be configured to dampen one or more frequencies or ranges of frequencies between one hundred eighty Hertz and two thousand Hertz. For example, in some embodiments, the porous structure of the combustor may be configured to dampen frequencies at one thousand Hertz. The parameters of the porous structure may be varied in different portions of the damper. In addition, more than one component of the combustor 230 may have a porous structure with differing parameters from other components. By varying these parameters in different components, or in different portions of the same component, or some combination thereof, damping of the effects of combustion dynamics may be achieved for different frequencies, different ranges of frequencies, overlapping ranges of frequencies, or a combination thereof. For example, if the component is a porous cowl, the portion of the cowl for each cup can be fine-tuned to work for a particular frequency or range of frequencies.

Some embodiments provide a porous component with a network or a lattice of multiple channels throughout the structure. The length, width, shapes, and other parameters of the channels can be tuned in different zones of the component such that the damper is effective for multiple frequencies.

Figure 4:
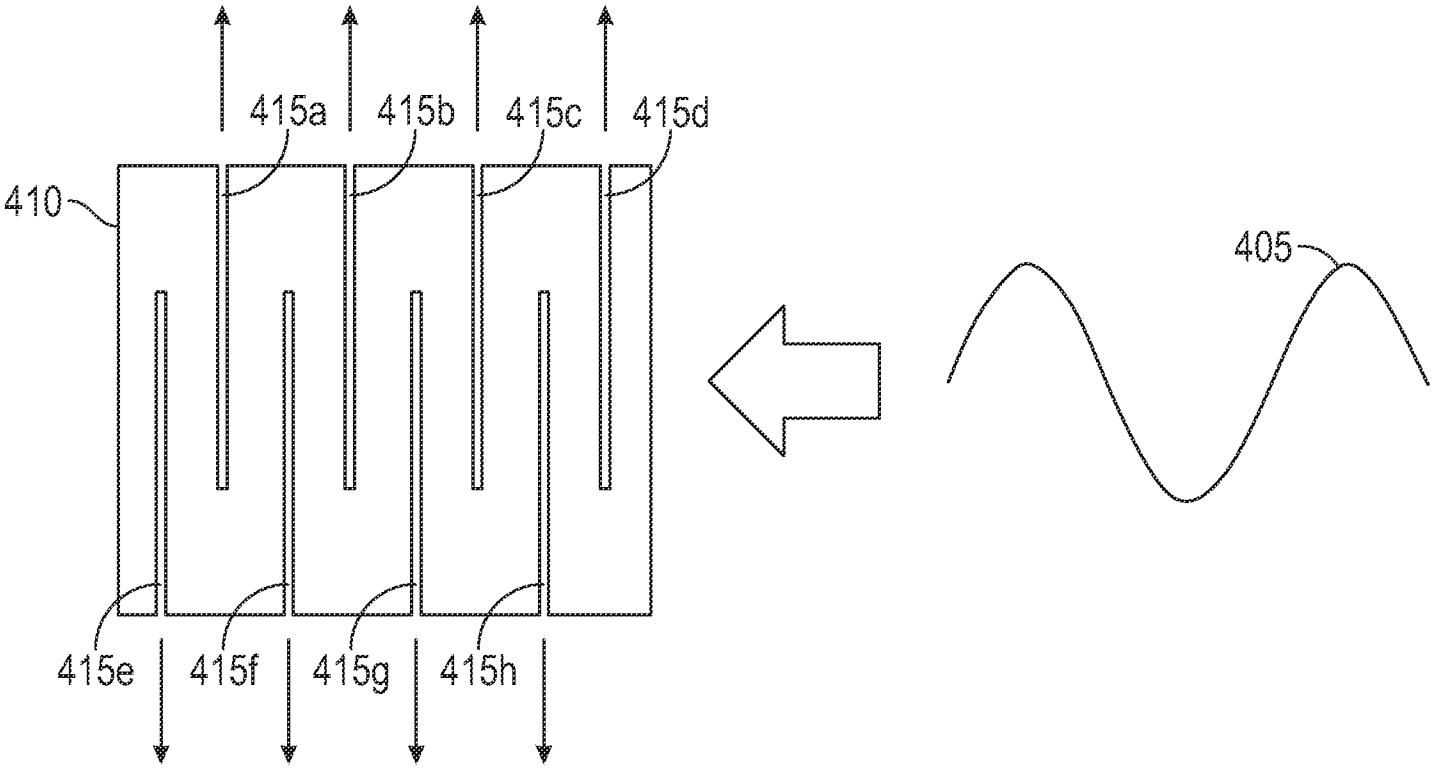
FIG. 4 schematically illustrates a pressure wave interacting with a porous structure, according to aspects of the present disclosure.

FIG. 4 schematically illustrates a pressure wave 405 interacting with a porous structure 410, according to some aspects of the present disclosure. The porous structure has multiple transverse channels 415*a*, 415*b*, 415*c*, 415*d*, 415*e*, 415*f*, 415*g*, and 415*h* for heat loss and viscous dissipation. The pressure wave 405 may enter the porous structure 410 via a longitudinal channel (not shown in FIG. 4) that is in fluid communication with the combustion chamber 302 (not shown in FIG. 4). As the pressure wave 405 passes through the porous structure 410, acoustic energy is transferred from the pressure wave 405 to the air within the transverse channels 415*a* to 415*h*. Therefore, as the pressure wave 405 travels through the transverse channels 415*a* to 415*h*, the pressure wave 405 loses a portion of its acoustic energy due to increased viscous dissipation to absorption by the air within the channels. This loss of energy dampens (reduces) the acoustic energy of the pressure wave 405 as the pressure wave 405 propagates through the porous structure 410. The energy absorbed by the air within the transverse channels 415*a* to 415*h* is radiated outwards, in the direction of the arrows.

The length of the channels affects the damping frequency. If a length of a channel is equal to a quarter wavelength of the pressure wave, then the wave will reflect off the end of the channel. The damper can be configured with channels of varying lengths to allow for broad-band damping of different frequencies.

Figure 5A:
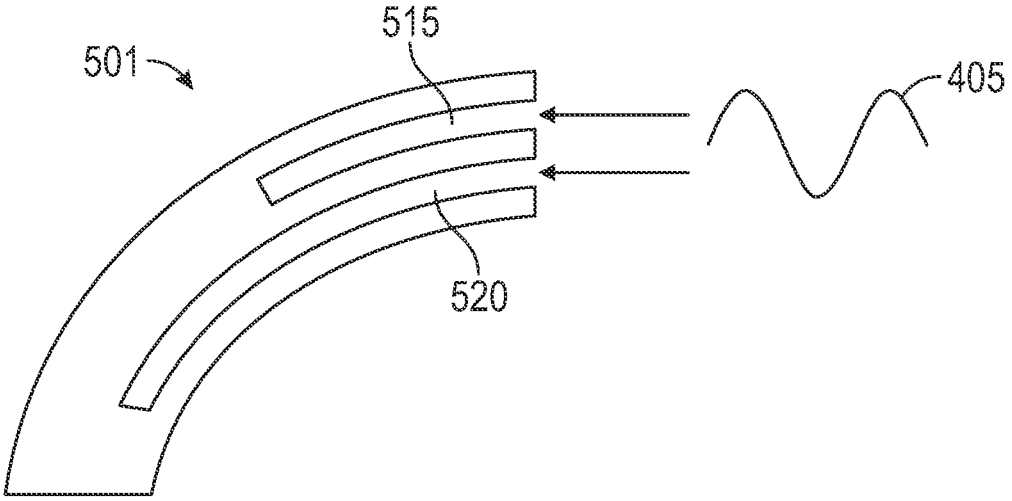
FIG. 5A schematically illustrates different channels of different lengths and shapes within the same combustor component, according to aspects of the present disclosure.

FIG. 5A schematically illustrates different channels of different lengths and shapes within the same combustor component, according to aspects of the present disclosure. In this example, a combustor component 501 has two curved channels 515, 520 that receive pressure waves 405 from the combustor (not shown). The length of curved channel 515 is half the length of curved channel 520, meaning that curved channel 515 is tuned for damping pressure waves with a frequency half that of those damped by curved channel 520. In this example, the component 501 is the outer half of a two-piece cowl.

Figure 5B:
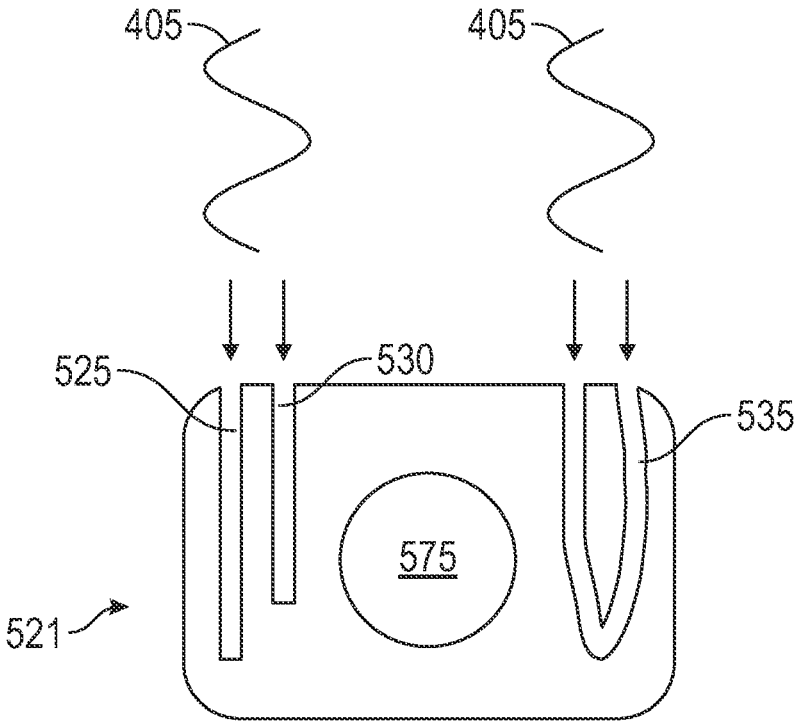
FIG. 5B schematically illustrates that longer frequencies can be damped by using longer channels, according to aspects of the present disclosure.

FIG. 5B schematically illustrates that longer frequencies can be damped by using longer channels, according to aspects of the present disclosure. In this example, combustor component 521 has long, straight channels 525 and 530 that receive pressure waves 405 from the combustor (not shown). The distance that the pressure waves 405 travels through the component 521 can be further increased by having a loop channel 535. In this example, the component 521 is a section of a unitary cowl with an opening 575 to receive a fuel nozzle (not shown).

The width of the channel also has an impact on thermal dissipation, by enabling absorption of energy from the pressure wave 405 into the material of the porous structure itself. The thermal dissipation of a pressure wave can be quantified by a thermal penetration depth, which is the distance that heat can diffuse though a material during a characteristic time that is the inverse of the frequency. For a given material, the thermal penetration depth $T_D$ can be defined:

$$T_D=\sqrt{2\cdot K/(\rho\cdot C_p\cdot f)} \quad (1)$$

where K is the thermal conductivity of the material, ρ is the density, $C_p$ is the specific heat capacity of the material, and f is the frequency of the pressure wave. In some embodiments, the channel width can be configured to optimize thermal dissipation, by having the width be at most two to four times the thermal penetration depth for a given frequency of pressure wave.

Figure 6:
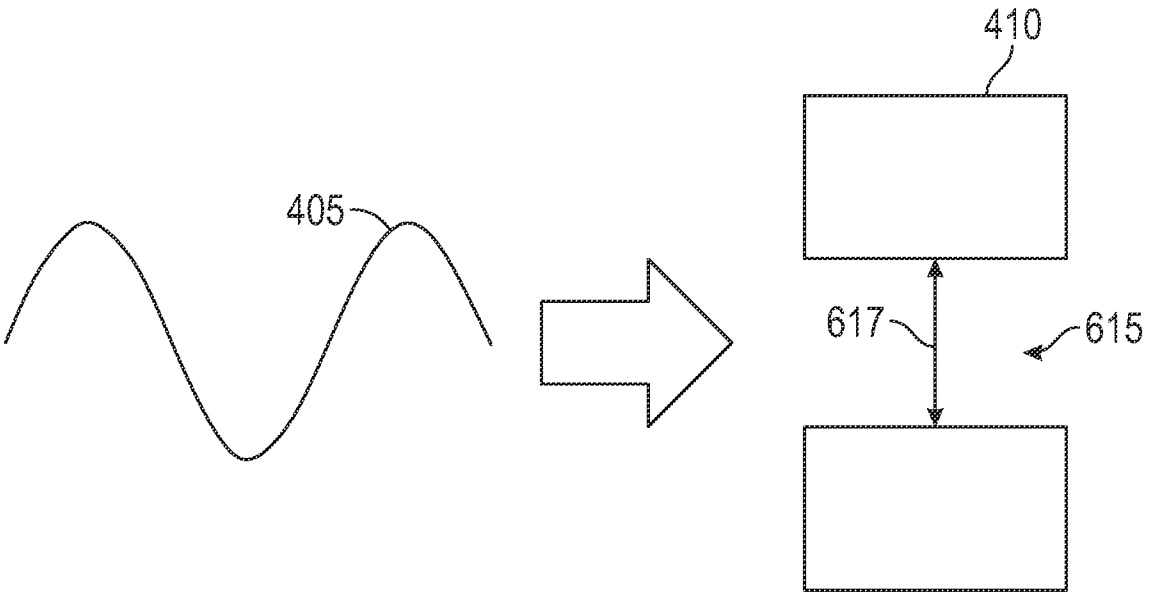
FIG. 6 schematically illustrates a pressure wave interacting with a channel having a thermal penetration depth tuned to a particular wave frequency, according to aspects of the present disclosure.

FIG. 6 schematically illustrates a pressure wave 405 interacting with a channel 615 having a thermal penetration depth tuned to a particular wave frequency, according to aspects of the present disclosure. In this example, the pressure wave 405 has a frequency f, and a corresponding thermal penetration depth·$T_D$ calculated by Equation (1). Accordingly, the channel width 617 is designed to have a maximum value of 4·$T_D$. If the width of the channel is too wide (e.g., greater than 4·$T_D$) then the effectiveness of the thermal dissipation through the material is reduced for frequency f.

As an example, for pressure waves with a frequency f of one thousand Hertz, the channel width 617 would be, at maximum, eighteen thousandths of an inch, or mils (e.g., 0.46 millimeters, or mm). For pressure waves with a frequency f of two hundred Hertz, the channel width 617 would be, at maximum, forty mils (e.g., 1.02 mm). These are examples of ranges of pressure waves that may be encountered, for example, during take-off conditions for some turbomachine engines in an aircraft. Accordingly, a damper for such an engine could be configured with channels having widths ranging between fifteen to fifty mils (e.g., 0.38 mm to 1.27 mm) to ensure broad-band damping over the entire range of pressure wave frequencies that might be encountered. In other embodiments, corresponding to different turbomachine engine designs and performance requirements, the channels may have widths ranging from ten mils to one hundred mils (e.g., 0.25 mm to 2.54 mm).

In some embodiments, the porous structure of the combustor 230 component is one of a gyroid, a honeycomb, a triply periodic minimal surface (TPMS), a degyroid, or a combination thereof. As examples, gyroid or other lattice structures can be three-dimensionally (3D) printed with metals or metal alloys. These provide an abradable-tolerant design, very high surface area, and a low weight to area (or volume) ratio. Gyroid, TPMS, honeycomb, degyroid, and other various shapes or lattices can be 3D printed in combination based on required properties to be targeted, such as frequency modulation, heat transfer effectiveness, weight modulation, noise modulation, strain modulation etc.

Gyroid geometries in particular also help to reduce the deflection of the component due to mechanical vibration during engine operation. The weight of the porous structure can be designed such the weight of the porous combustor component remains the same relative to a baseline (e.g., a non-porous component) or lighter, while simultaneously providing equivalent, sufficient, or superior mechanical strength. Gyroid structures can be manufactured using additive manufacturing (e.g., 3D printing) with metals, which allows the unit cell sizes and porosity to be variable controlled from zone to zone, covering a wide range of frequencies as required and tuning the structure to achieve desirable mechanical performance.

Figure 7A:
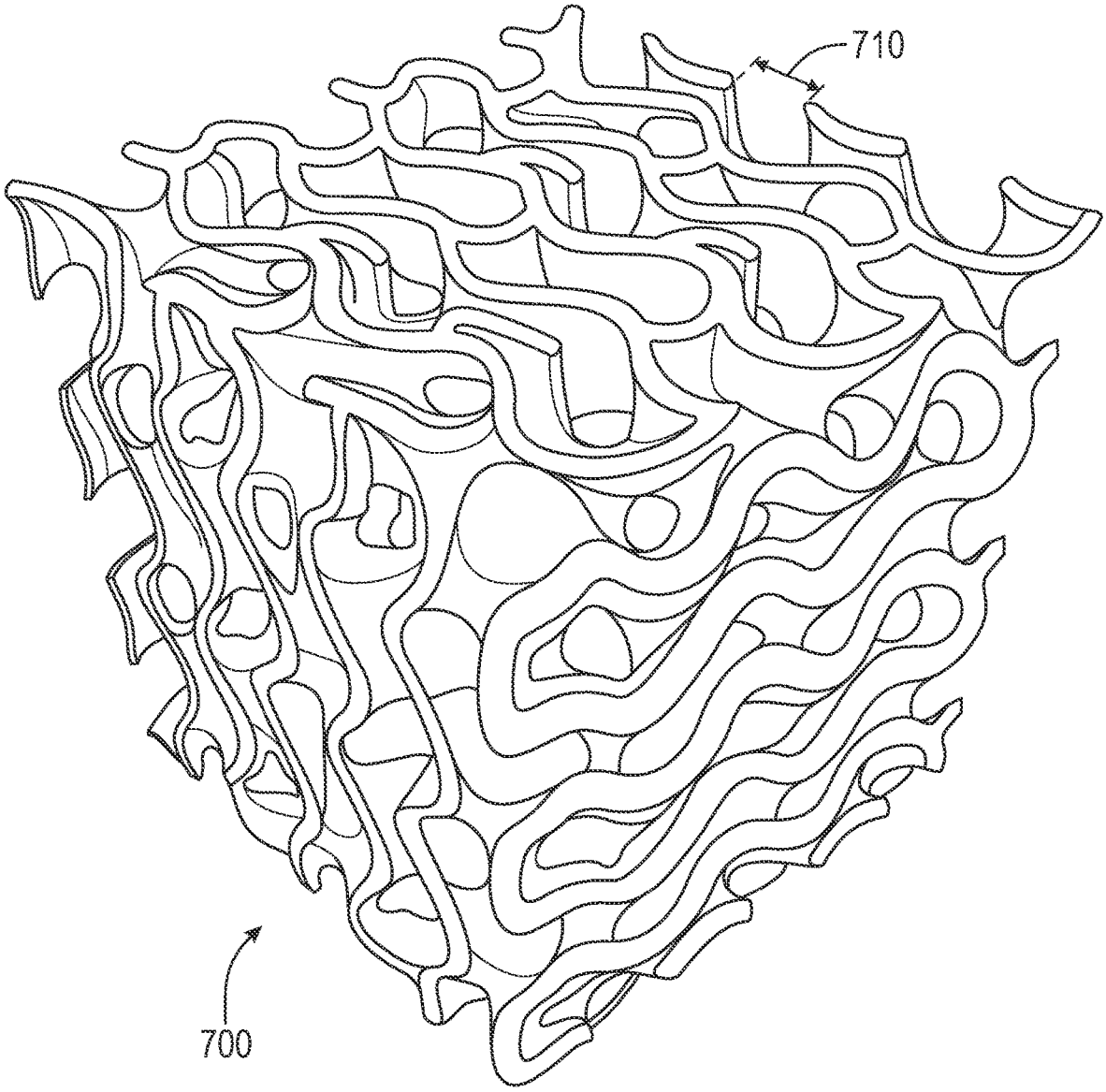
FIG. 7A illustrates an example of a gyroid shape with at least one unit cell diameter that can be tuned to provide acoustic and thermal dissipation at one or more frequencies, according to aspects of the present disclosure.

FIG. 7A illustrates an example of a gyroid structure 700 with at least one unit cell diameter 710 that can be tuned to provide acoustic and thermal dissipation at one or more frequencies, according to aspects of the present disclosure. The unit cells are interconnected, creating torturous channels throughout the gyroid volume in three dimensions. An advantage of gyroid shapes is that they provide an improvement in the mechanical properties of the component in addition to damping the combustion dynamics. Gyroids have very good energy absorption capacity, taking a longer time to attain energy saturation than solid structures. This more gradual energy absorption behavior helps gyroid structures to absorb more energy over time. By building porous combustor components with gyroid structures instead of being solid, the energy absorption capabilities (e.g., damping of mechanical vibration) of the combustor components are improved by a great margin. By varying the geometric properties of the gyroid (e.g., cell shape, size, symmetry pattern, etc.), the mechanical properties of the combustor component can also be tuned, to deliver optimum strength and durability.

Figure 7C:
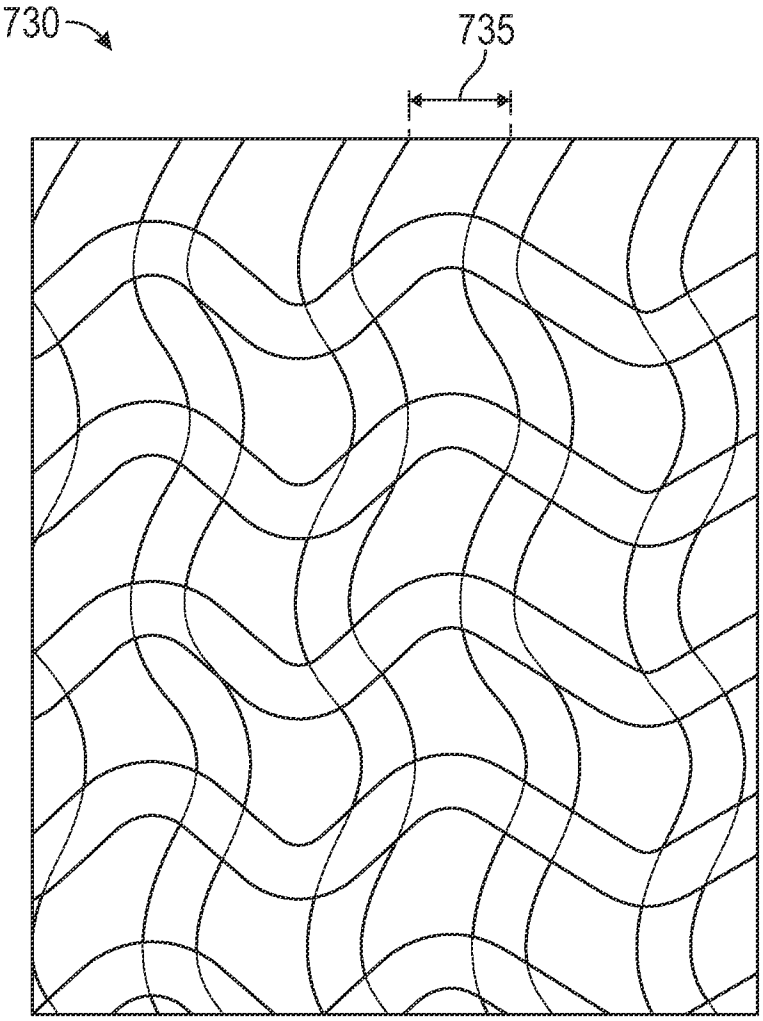
FIG. 7C shows a region of the gyroid structure in FIG. 7A, the region having a medium to high porosity, according to aspects of the present disclosure.
Figure 7B:
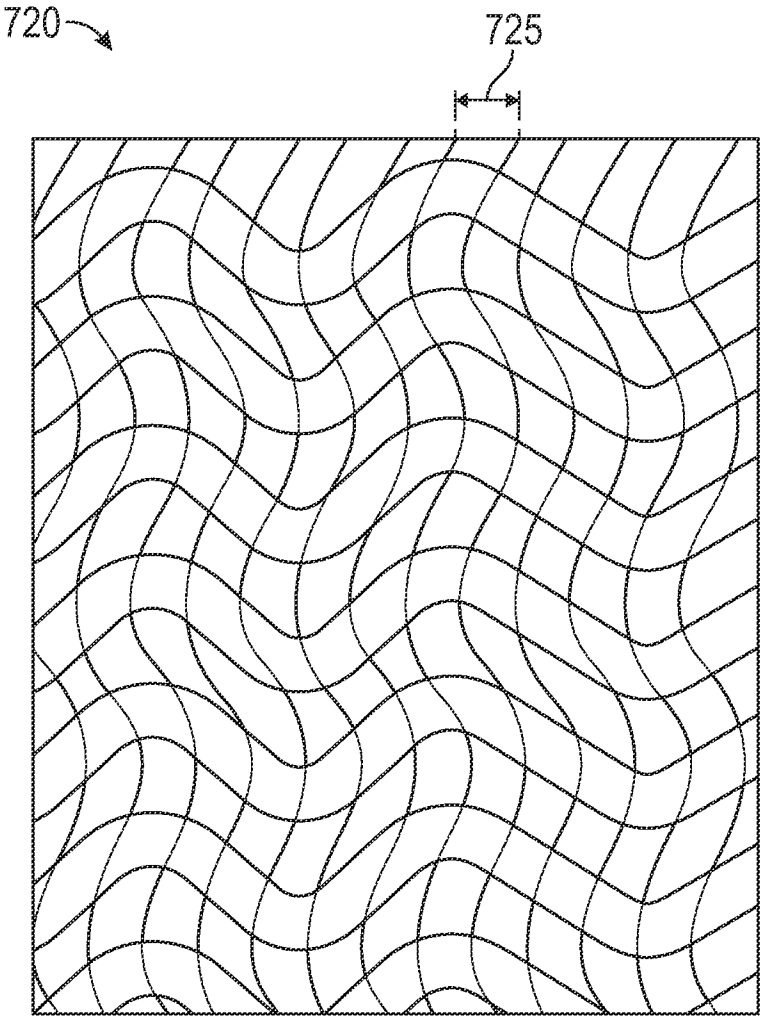
FIG. 7B shows a region of the gyroid structure in FIG. 7A, the region having a low porosity, according to aspects of the present disclosure.

As the gyroid structures are printed additively in some embodiments, the unit cell size can be controlled, and the structures tuned to achieve desirable mechanical performance by changing the unit cell density. The porosity of any given cross section within the gyroid can be varied as needed, for tailored stiffness and weight. For example, FIG. 7B shows a region 720 of the gyroid structure 700 in FIG. 7A, the region 720 having a low porosity, according to aspects of the present disclosure. In region 720, the unit cell density is relatively high, and the unit cell diameter 725 is relatively small. As another example, FIG. 7C shows a region 730 of the gyroid structure 700 in FIG. 7A, the region 730 having a medium to high porosity, according to aspects of the present disclosure. In region 730, the unit cell density is relatively low, and the unit cell diameter 735 is relatively large.

Several preferred embodiments of porous combustor components will now be described. Any of the various features discussed with any one of the embodiments discussed herein may also apply to and be used with any other embodiments.

Figure 8B:
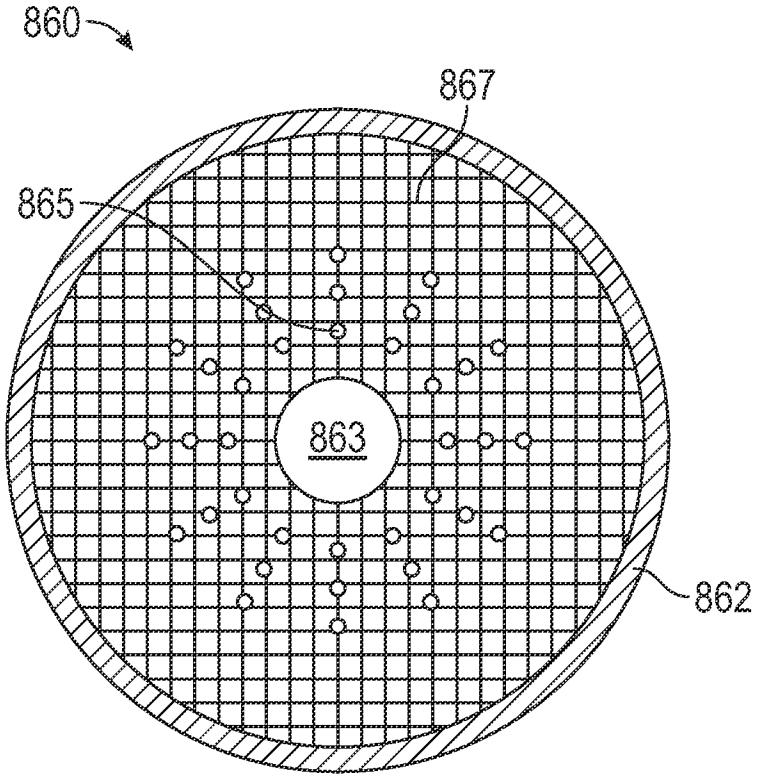
FIG. 8B shows an axial cross-sectional view of the porous ferrule of FIG. 8A, taken along line 8B-8B in FIG. 8A from the aft direction looking forward.
Figure 8A:
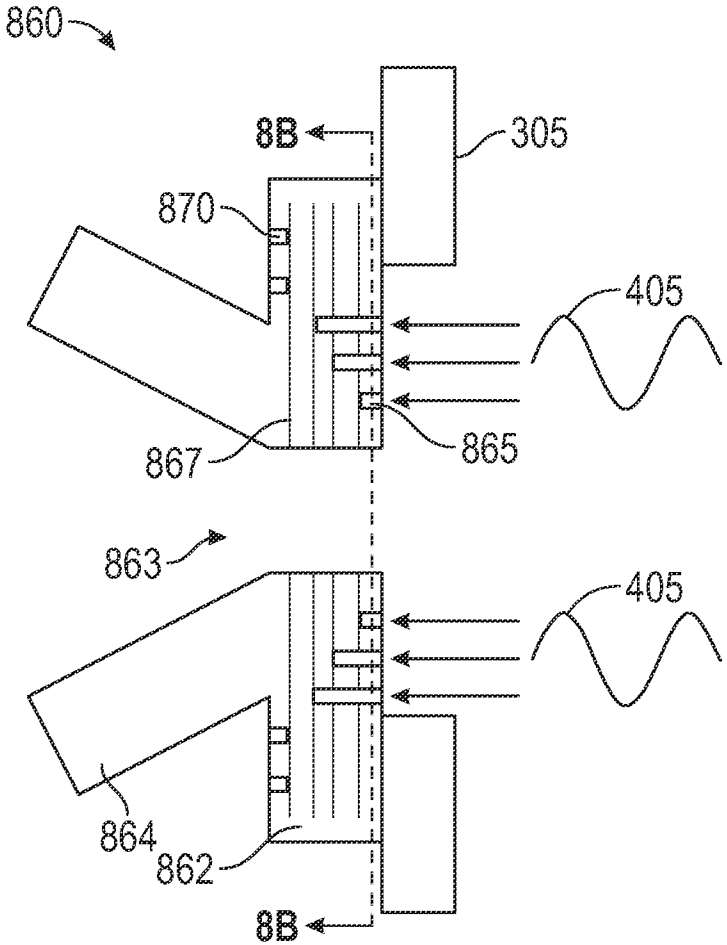
FIG. 8A shows a schematic cross-sectional view of a porous ferrule, according to aspects of the present disclosure.

FIG. 8A shows a schematic view of a porous ferrule 860, according to aspects of the present disclosure. The porous ferrule 860 is positioned forward of the dome 305 and serves to align the fuel nozzle 306 (FIG. 3). The porous ferrule 860 has a main body 862 that is adjacent to the dome 305 and which has an annular shape about an opening 863 to receive the fuel nozzle 306. In addition, the porous ferrule 860 has arms 864 located forward of the main body 862, that serve to align the fuel nozzle 306 with the opening 863.

In this example, the porous ferrule 860 includes multiple longitudinal channels 865 in the main body 862 that open towards the aft direction, oriented parallel to the centerline axis 220 (FIG. 2), to allow pressure waves 405 from the combustion chamber 302 (FIG. 3) to enter. The porous ferrule 860 also includes transverse channels 867 in the main body 862, oriented orthogonally to the centerline axis 220 (FIG. 2), intersecting the longitudinal channels 865 and enabling the pressure waves 405 to undergo acoustic and thermal dissipation, as discussed above with reference to FIGS. 4 to 6. In some embodiments, the arms 864 of the porous ferrule 860 may also have longitudinal channels 865, transverse channels 867, or both.

The longitudinal channels 865 and the transverse channels 867 can include different lengths and widths to allow for a broad range of thermal penetration depth and quarter wavelength values, for damping of pressure waves over a broad range of frequencies. In some embodiments, the porous ferrule 860 is configured to dampen frequencies between one hundred eighty Hertz and two thousand Hertz. In some embodiments, the porous ferrule also has metering holes 870 on the cold side (e.g., the forward side), to provide a small amount of bias flow, in order to improve the broad frequency damping.

FIG. 8B shows an axial cross-sectional view of the porous ferrule 860, taken along line 8B-8B in FIG. 8A, from the aft direction looking forward. A lattice of the transverse channels 867 are visible in this view, oriented orthogonally to the centerline axis 220 (FIG. 2). The length and the width of the transverse channels 867 may be varied between different zones of the porous ferrule 860, or intermingled throughout the entire component. Some openings for the longitudinal channels 865 are also visible in this view. In this example, the longitudinal channels 865 are arranged in concentric rings, though other geometric arrangements are contemplated, including but not limited to random patterns and rectilinear grids. The number of transverse channels 867 and longitudinal channels 865 and their patterns as shown in FIG. 8A and FIG. 8B are just an example, and the numbers and patterns thereof may be different in other embodiments.

Figure 9:
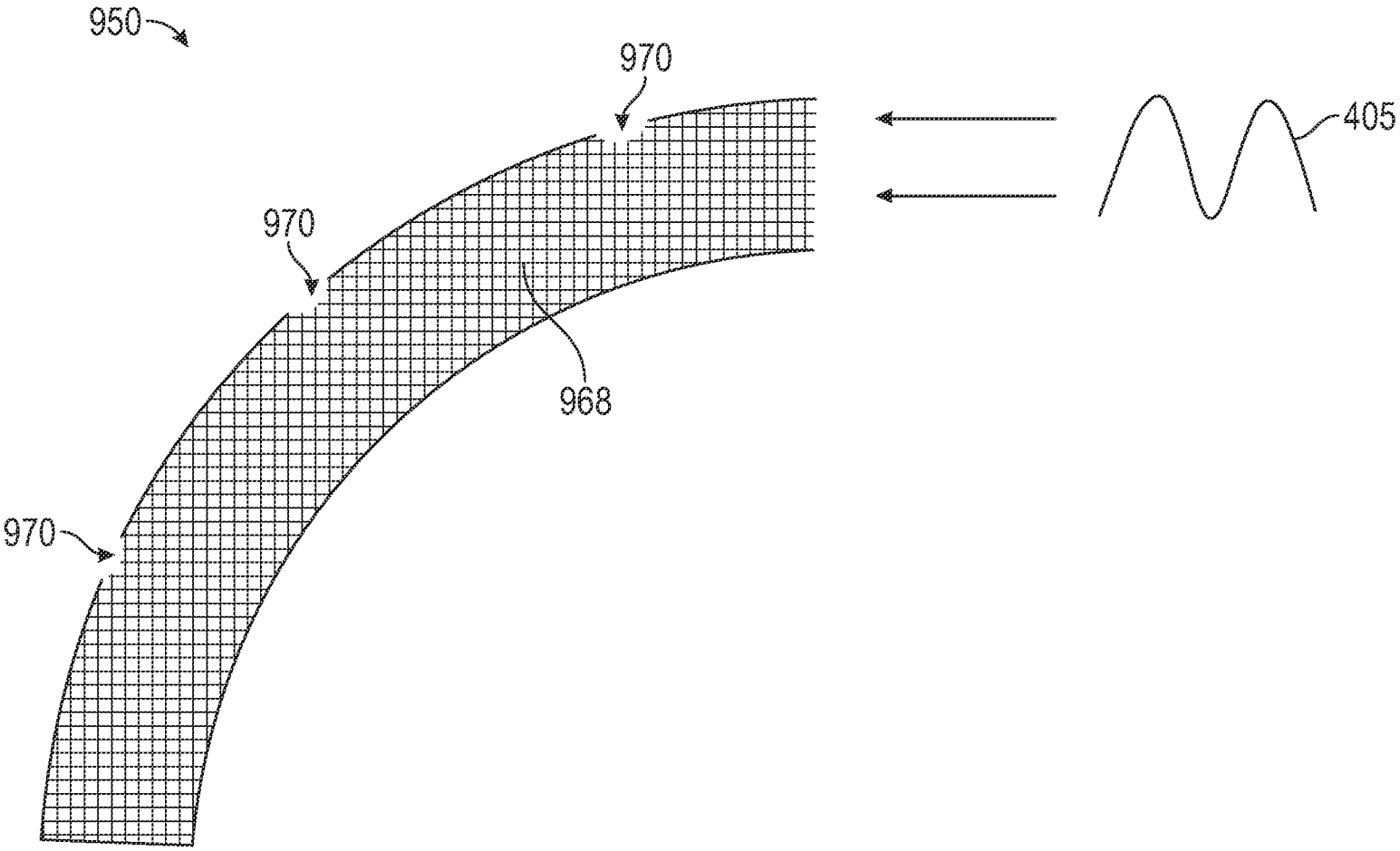
FIG. 9 shows a schematic view of a porous cowl, according to aspects of the present disclosure.

FIG. 9 shows a schematic view of a porous cowl 950, according to aspects of the present disclosure. The porous cowl 950 in this example is an outer cowl, and has a lattice 968 of channels in flow communication with the combustion chamber 302 (not shown in FIG. 9) that allow pressure waves 405 to enter and to undergo acoustic and thermal dissipation, as described above with reference to FIGS. 4 to 6. These channels in the lattice 968 have different lengths and widths to allow for a broad range of thermal penetration depth and quarter wavelength values, to dampen pressure waves over a wide range of frequencies. The number of channels in the lattice 968 and their pattern as shown in FIG. 9 are just an example, and the number and pattern thereof may be different in other embodiments.

In some embodiments, the porous cowl 950 is configured to dampen frequencies between one hundred eighty Hertz and two thousand Hertz. In some embodiments, the porous cowl also has metering holes 970 on the cold side (e.g., the forward side), to provide a small amount of bias flow, in order to improve the broad frequency damping.

Though the lattice 968 is shown as uniform in this example, the density of channels within the lattice 968 may vary from zone to zone within the porous cowl 950. The corresponding inner cowl (not shown in FIG. 9) may have a lattice with the same density of channels, a different density, a variable density, or a uniform density, and the channels therein may also have different lengths and widths, to allow for a different or overlapping range of thermal penetration depths and quarter wavelength values, to dampen pressure waves over a different or overlapping range of frequencies.

In some embodiments, the porous cowl 950 has a unitary cowl design with different regions (e.g., different sets of cups around the circumference of the combustor, different zones in the axial direction, etc.) being tuned for damping different frequencies. In some embodiments, the porous cowl 950 has a split-cowl design with an inner cowl and an outer cowl, with at least a portion of the inner cowl being tuned for one range of frequencies and at least a portion of the outer cowl being tuned for another, different range of frequencies.

Figure 10:
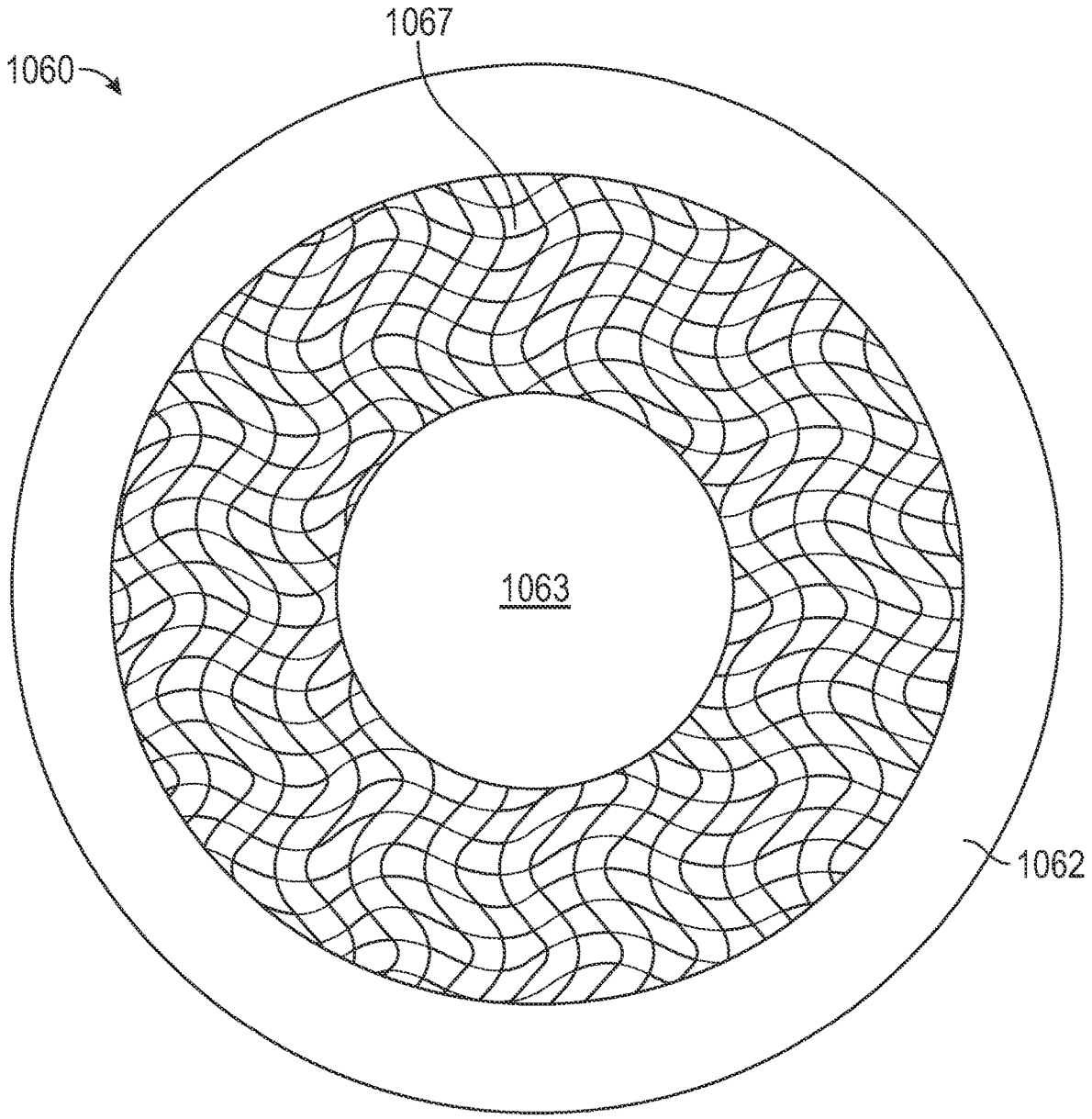
FIG. 10 shows a schematic, axial view of a porous ferrule, according to aspects of the present disclosure.

FIG. 10 shows a schematic, axial view of a porous ferrule 1060, according to aspects of the present disclosure. The porous ferrule 1060 has a main body 1062 that has an annular shape about an opening 1063 to receive the fuel nozzle 306 (FIG. 3). In this example, the porous ferrule 1060 has a gyroid internal structure 1067, to allow pressure waves from the combustion chamber 302 (not shown in FIG. 10) to enter and to undergo acoustic and thermal dissipation. The gyroid may have multiple cell diameters to allow for a broad range of acoustic and thermal dissipation at one or more frequencies. The gyroid internal structure 1067 as shown in FIG. 10 is just an example, and the internal structure may be different in other embodiments.

Figure 11:
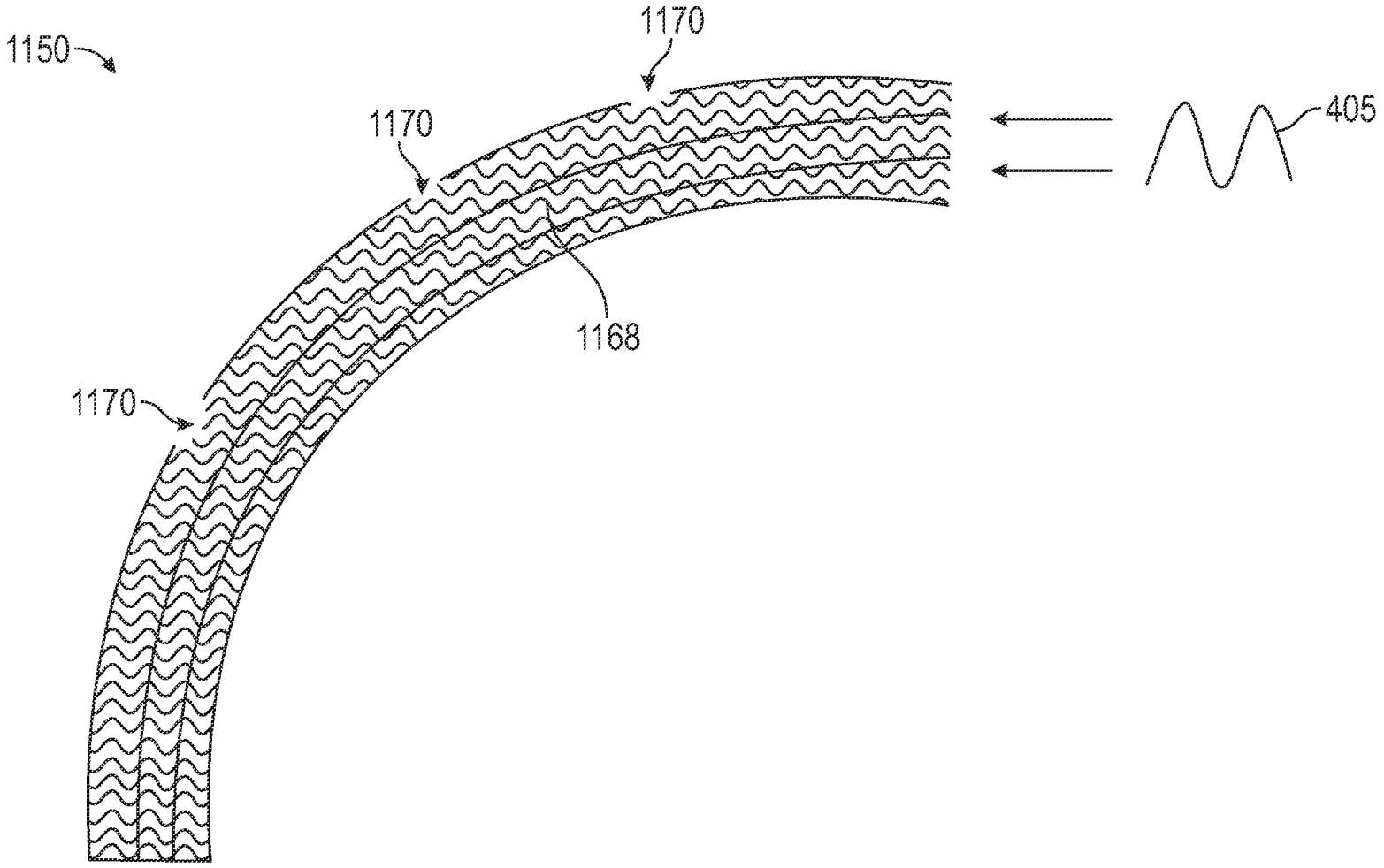
FIG. 11 shows a schematic view of a porous cowl, according to aspects of the present disclosure.

FIG. 11 shows a schematic view of a porous cowl 1150, according to aspects of the present disclosure. The porous cowl 150 in this example is an outer cowl, and has a gyroid structure 1168 in flow communication with the combustion chamber 302 (not shown in FIG. 11) that allows pressure waves 405 to enter and to undergo acoustic and thermal dissipation, as described above with reference to FIGS. 4 to 6. The unit cells in the gyroid structure 1168 have different diameters, cross sections, and sizes to allow for a broad range of thermal penetration depth and quarter wavelength values, to dampen pressure waves over a wide range of frequencies. In some embodiments, the porous cowl 1150 is configured to dampen frequencies between one hundred eighty Hertz and two thousand Hertz. In some embodiments, the porous cowl also has metering holes 1170 on the cold side (e.g., the forward side), to provide a small amount of bias flow, in order to improve the broad frequency damping.

Though the gyroid structure 1168 is shown as uniform in this example, the density of unit cells within the gyroid structure 1168 may vary from zone to zone within the porous cowl 1150. The corresponding inner cowl (not shown in FIG. 11) may have a gyroid structure with the same density of unit cells, a different density, a variable density, or a uniform density, and the unit cells therein may also have different diameters, cross sections, and sizes, to allow for a different or overlapping range of thermal penetration depths and quarter wavelength values, to dampen pressure waves over a different or overlapping range of frequencies. The gyroid structure 1168 as shown in FIG. 11 is just an example, and the internal structure may be different in other embodiments.

In some embodiments, the porous cowl 1150 has a unitary cowl design with different regions (e.g., different sets of cups around the circumference of the combustor 230, different zones in the axial direction, etc.) being tuned for damping different frequencies. In some embodiments, the porous cowl 1150 has a split-cowl design with an inner cowl and an outer cowl, with at least a portion of the inner cowl being tuned for one range of frequencies and at least a portion of the outer cowl being tuned for another, different range of frequencies.

Figure 12A:
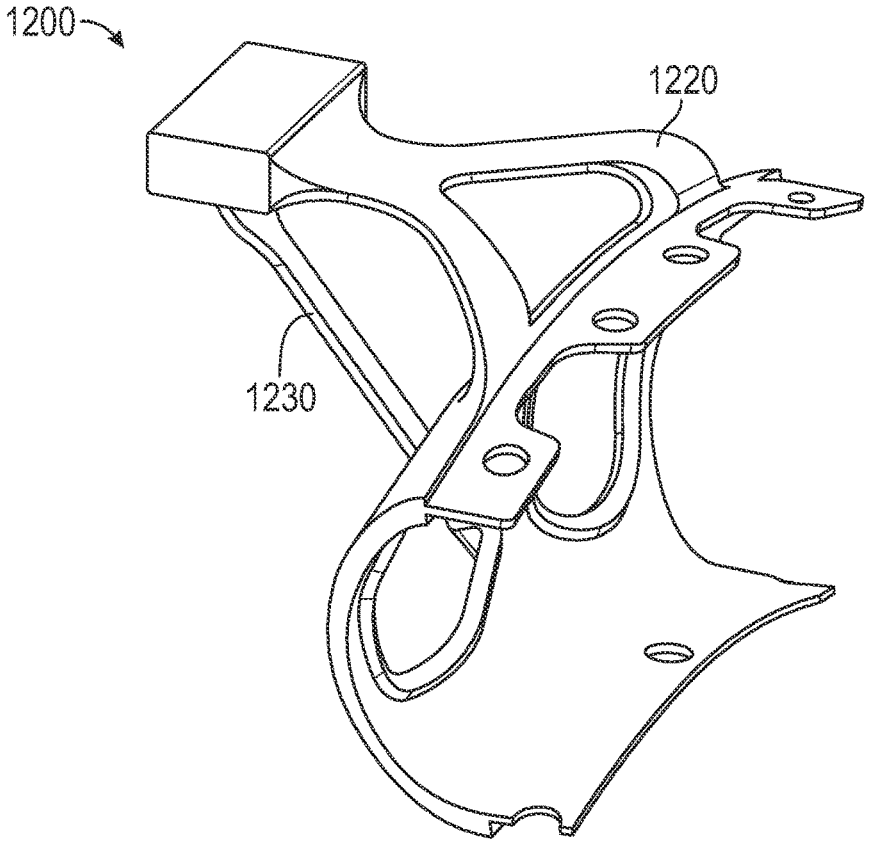
FIG. 12A shows a portion of a cowl with a mounting arm and a radial support, according to aspects of the present disclosure.

FIG. 12A shows a portion of a cowl 1200, having a mounting arm 1220 and a radial support arm 1230, according to aspects of the present disclosure. In this example, the cowl 1200 is a unitary cowl, and the portion of the cowl 1200 spans two fuel nozzles (omitted from FIG. 12A for clarity). Additional mounting arms and radial support arms (not shown) are positioned circumferentially around the centerline axis 220 to support the rest of the cowl 1200. The number of mounting arms and radial support arms required to support the cowl 1200 may vary, depending on the design and deformation requirements of the cowl 1200. Other cowl configurations are contemplated, such a split-cowl design with an inner cowl and an outer cowl. The inner cowl and the outer cowl may have separate mounting arms, separate radial support arms, or some combination thereof. In the example of FIG. 12A, the mounting arm 1220 is shown to have a V-shape, though in other embodiments the support arm may be any other shape, or be a 360-degree continuous support around the circumference of the combustor 230.

In some embodiments, the position of the mounting arm 1220 may create blockages in the flow of cooling air from the diffuser 335 (FIG. 3) to the outer liner 310 (FIG. 3), resulting in turbulent wakes on the cowl 1200 and the outer liner 310. These wakes may lead to pressure loss, and the resulting feed of cooling air to the dilution holes along arrows 345 (FIG. 3) may not be uniform in the circumferential direction. If the feed to the dilution holes is not uniform, and if the penetration varies, a variation in cup-cup combustor exit temperature may result. These effects may cause the exhaust gas temperature (EGT) spread from the combustor 230 to vary more than the acceptable limits.

Moreover, a separated and non-uniform flow along the outer liner 310 may reduce dilution penetration and the environmental footprint and the efficiency of the turbomachine engine 100. The heat transfer coefficient (HTC) on liner wall in the primary zone may also be lower due to the separate flow, which may lead to durability issues. Likewise, similar issues may arise for the feed of air to the swirler 316 (FIG. 3) beneath the cowl 1200, due to turbulent wakes off of the radial support arm 1230.

In some embodiments of the present disclosure, one or more of the components of the combustor 230, and more specifically one or more components of the cowl 1200, may be made porous to reduce or to eliminate the effects of turbulent flow wakes around the cowl 1200, and thereby improve the BFM for the feed to the dilution holes. The proposed porous components may be additively printed, which may provide improved mechanical strength, energy absorbing capability, aerodynamic performance, and lower weight (due to reduced density) for an improvement in specific fuel consumption (SFC), relative to traditional manufacturing methods.

Advantages of the proposed porous components include enabling an increased exit velocity of air from the diffuser 335, which facilitates length reduction of the combustor 230 overall, and absorption of mechanical vibrations (e.g., from combustor diffuser nozzle casings), keeping the combustor's structure unperturbed. Improving the velocity profile of the air in the passages between the liners and the walls of the cowl is especially important for improving the BFM.

The porous component may be made porous by including any type and number of voids within the solid structure, including but not limited to a lattice, a truss, holes of varying size and shapes, slots, a gyroid structure, a geodesic structure, or any combination thereof. The porosity of any given cross section (e.g., the ratio of the volume of void to the solid volume) may vary, for example from 0.3 to 0.8 in some embodiments. The porosity may vary along different dimensions, and may vary in different regions of the porous component, depending upon structural strength requirements. Continuous 360-degree supports may have higher porosity than periodic supports, due to having an increased effective surface contact area. The porosity may be varied by having different sizes and shapes of the voids and openings in the porous component.

The aerodynamic path for air to travel within the porous component may be linear, and may be oriented in any direction, such as radially (e.g., perpendicular to the centerline axis 220), axially (e.g., parallel to the centerline axis 220), or at an arbitrary angle. Air pathways may also be nonlinear, e.g., curved or tortuous. Air pathways may also intersect within the porous component. The openings for the air pathways can be of different aerodynamic shapes, including, but not limited to, a circle, an oval, an ellipse, etc.

Figure 12B:
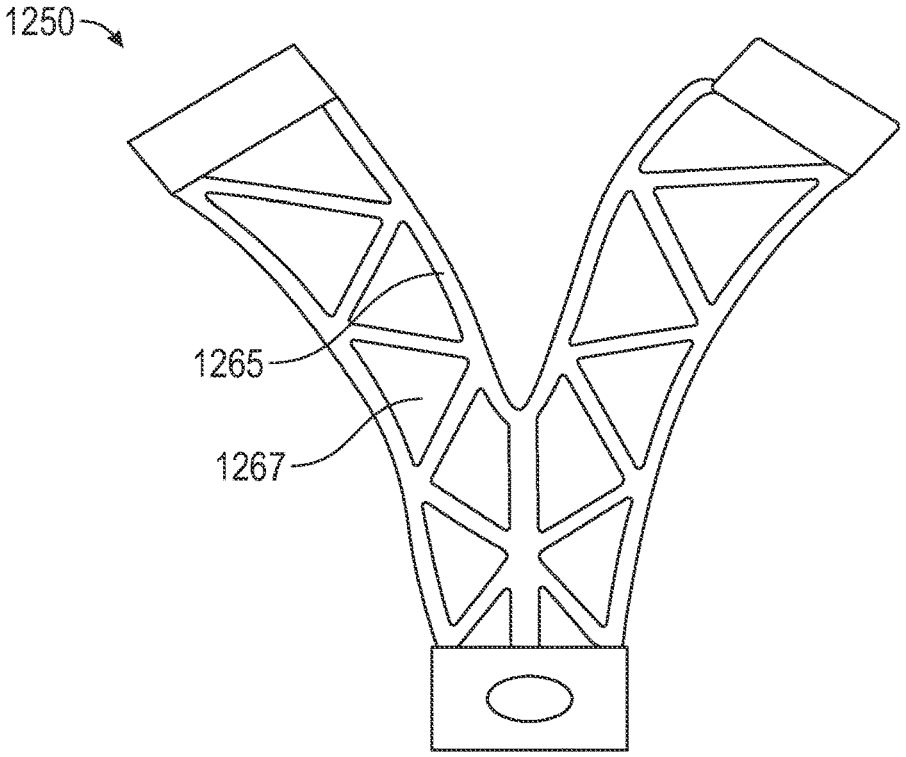
FIG. 12B shows an example of a porous cowl arm having a truss structure, according to aspects of the present disclosure.

FIG. 12B shows an example of a porous mounting arm 1250 for the cowl 1200 in FIG. 2A, according to aspects of the present disclosure. In this example, the porous mounting arm 1250 is made porous by having a truss structure, to permit cooling air to pass through the porous mounting arm 1250 rather than be forced to flow around the porous mounting arm 1250. In other embodiments, the porous mounting arm 1250 may have a gyroid structure instead of a truss structure.

The truss structure for porous mounting arm 1250 is composed of multiple struts 1265 arranged to define openings 1267 for the cooling air to pass through. The material density of the porous mounting arm 1250 is reduced relative to a solid arm, but structural integrity is retained due to the reinforcement of the truss. The side walls of the porous mounting arm 1250 may also be aerodynamically contoured to reduce stress concentration or corners. The smoother passage of air through the openings 1267 also improves BFM. In the example of FIG. 12B, the porous mounting arm 1250 is printed additively, allowing the size of the openings 1267 in the truss structure to be controlled and varied, to tune the truss structure to achieve desirable mechanical performance. In some embodiments, a combination of horizontal and vertical trusses can be employed to achieve a desired stiffness for damping mechanical vibrations.

The porous components may be manufactured using conventional methods, additive methods, or a hybrid method of both conventional and additive methods. Generally, more complex structures can be more easily made using additive methods, and hybrid manufacturing is more appropriate for the most complex shapes.

Figure 13:
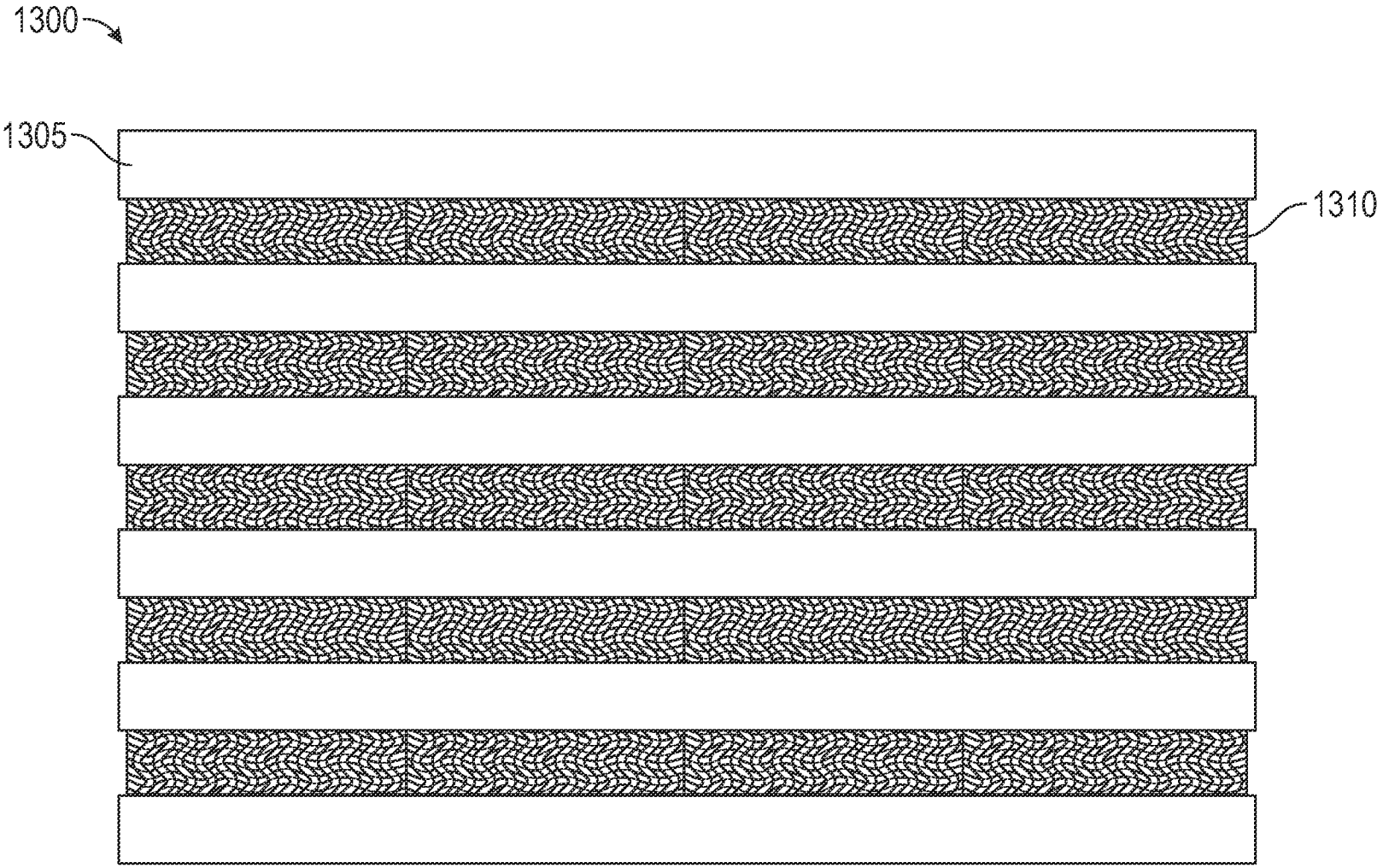
FIG. 13 shows an example of a porous component manufactured using a hybrid method that combines conventional and additive techniques, according to aspects of the present disclosure.

FIG. 13 shows an example of a porous component manufactured using a hybrid method that combines conventional and additive techniques, according to aspects of the present disclosure. The porous component 1300 may be, for example, a component of a combustor (e.g., a ferrule, a cowl, a liner, etc.) or may be, for example, a component of a cowl (e.g., a mounting arm, a radial support arm, etc.). The porous component has multiple layers of solid material 1305 and layers of porous material 1310. For example, in some preferred embodiments, there may be between two to eight layers. At least some of the layers of solid material 1305 may be manufactured using conventional manufacturing means, including but not limited to casting, stamping, etc. At least some of the layers of porous material 1310 may be manufactured using additive manufacturing, including but not limited to three-dimensional (3D) printing.

In some embodiments, each layer of porous material 1310 is characterized by a porosity. The layer of porous material 1310 is designed in some embodiments to have a porosity that is greater than zero and less than one. For example, in some preferred embodiments, the layer of porous material 1310 is designed to have a porosity between thirty percent and eighty percent.

Some or all of the layers of porous material 1310 may have a lattice of channels each characterized by at least a channel width, a channel length, and a channel shape. Some or all of the layers of porous material 1310 may be a truss that is characterized by at least one opening size. Some or all of the layers of porous material 1310 may have a gyroid structure, characterized by one or more unit cell diameters and unit cell densities.

The porosity of each layer of porous material 1310, the number of layers of porous material 1310, the number of layers of solid material 1305, the width of each layer of solid material 1305, the width of each layer of porous material 1310, and the characteristics of the porous structure of each layer of porous material 1310, may be controlled and varied, to tune the porous component 1300 to achieve tailored stiffness and weight, desirable mechanical performance, damping performance, turbulence control, BFM, or any combination thereof.

Figure 14:
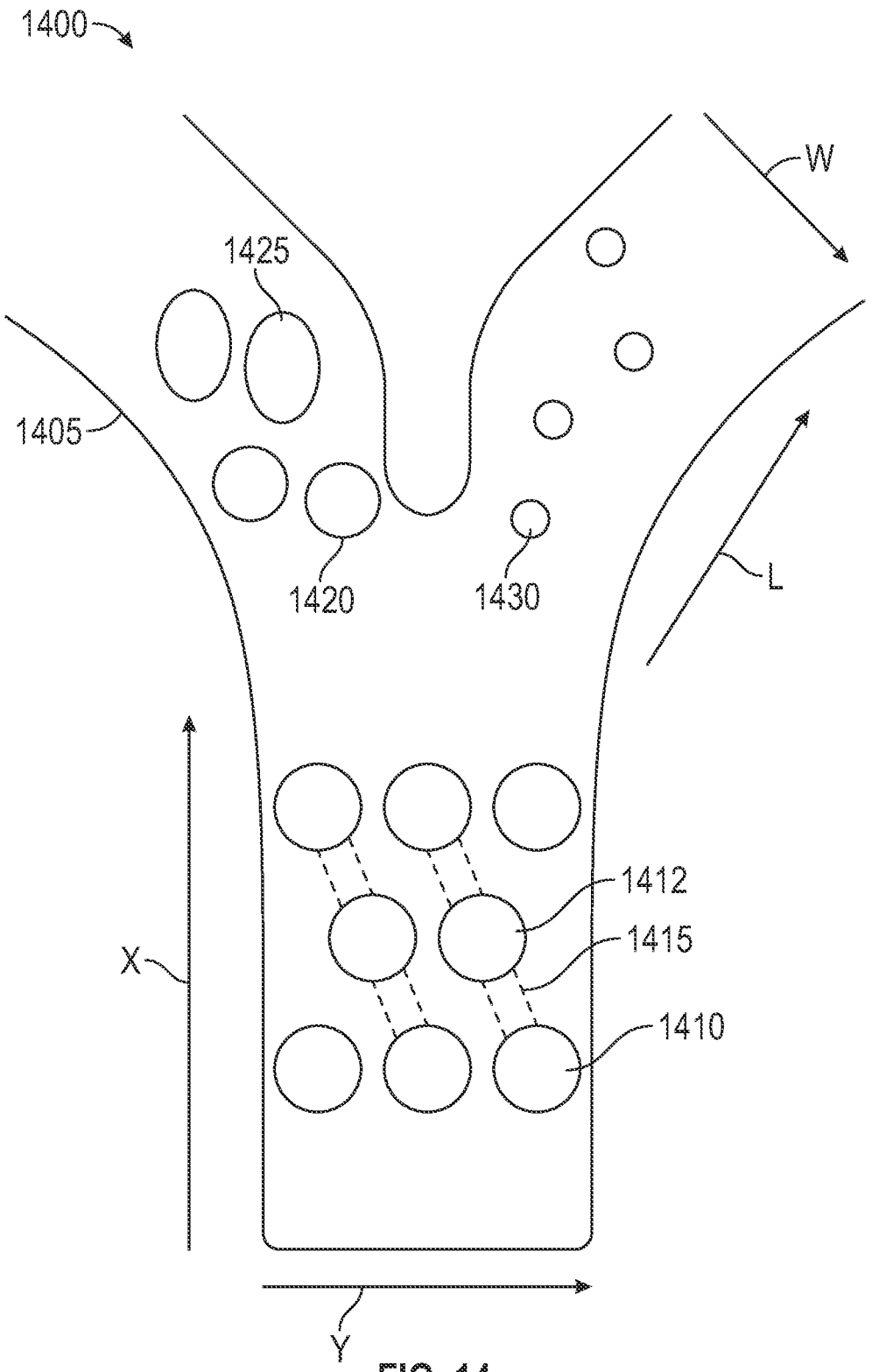
FIG. 14 shows an example of a porous cowl arm having holes, according to aspects of the present disclosure.

FIG. 14 shows an example of a porous cowl arm 1400 having holes, according to aspects of the present disclosure. The porous cowl arm 1400 has a metallic solid surface 1405 to avoid leakage of air from the sides. In this example, several holes (e.g., hole 1410 and hole 1412) are connected by transverse holes (indicated by dotted lines 1415) so that air may flow between them as air traverses through the porous cowl arm 1400. In addition, some holes such as hole 1420 have a circular shape, and other holes such as hole 1425 have an oval shape. Several holes, such as hole 1430, are circular like hole 1420, but have a smaller width. In some embodiments, the width of the holes may be 0.5 millimeters or larger.

As illustrated in the example of FIG. 14, the density and the size of holes are limited by the surface area of the component. The surface area may vary in different regions of the component. For example, the stem (e.g., the base of the "Y" shape) of the porous cowl arm 1400 has a width Y (in a circumferential direction) and a length X (in the radial direction). Accordingly, for N adjacent holes positioned along the circumferential direction, the maximum width of each hole would be Y/N. Likewise, for M adjacent holes positioned along the radial direction, the maximum width of each hole would be X/N.

As another example, the flanges (e.g., the arms of the "Y" shape) of the porous cowl arm 1400 have a length L and a width W. Accordingly, for N adjacent holes positioned along the length, the maximum width of each hole would be L/N. Likewise, for M adjacent holes positioned along the width, the maximum width of each hole would be W/N. The density, number, and size of holes can vary between one flange and the other, as well as between either flange and the stem. For example, in some preferred embodiments, the stem area may have up to 50% porosity, and the flange may have up to eighty percent porosity.

The number of holes that can be packed into the surface area of any region of the porous cowl arm 1400 can be increased by staggering the holes, using varying size holes, or a combination thereof. In practice, however, the number of holes that can be placed, and their relative sizes, may depend on the structural integrity and available surface area of the porous cowl arm 1400. In some preferred embodiments, the number of holes may be between two holes and twenty holes.

Figure 15:
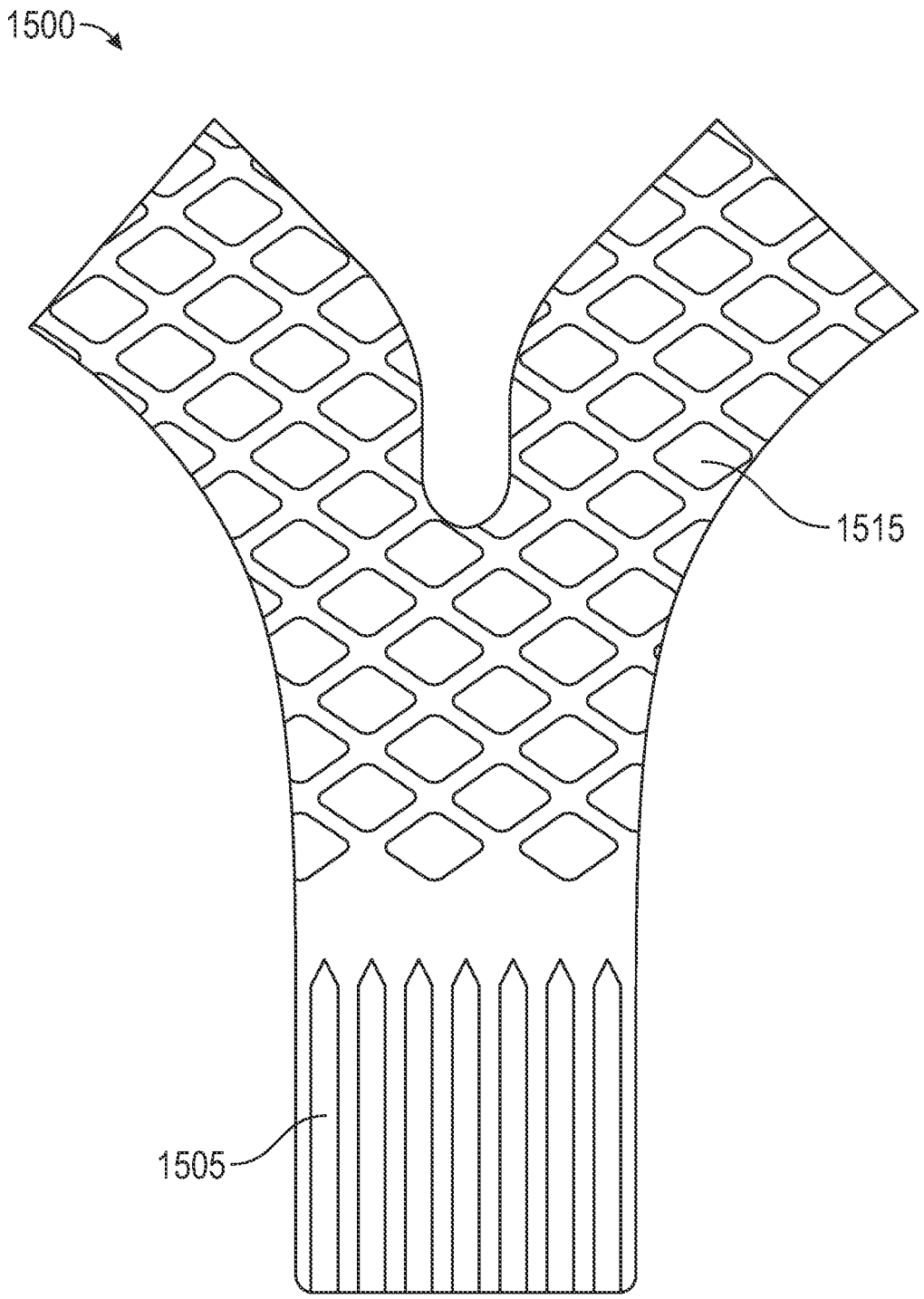
FIG. 15 shows an example of a porous cowl arm having a hybrid structure, according to some aspects of the present disclosure.

FIG. 15 shows an example of a porous cowl arm 1500 having a hybrid structure, according to some aspects of the present disclosure. The porous cowl arm 1500 uses slots 1505 for the stem, for increased porosity and BFM performance. The porous cowl arm 1500 uses a gyroid structure 1515 for the flanges, for improved damping of mechanical vibrations.

As shown in the example of FIG. 15, the outer perimeter of the porous cowl arm 1500 has a solid perimeter strip. In other words, the gyroid structure 1515 abuts the outer edges of the porous cowl arm 1500. However, in some embodiments, the gyroid structure 1515 does not abut the edges of the porous cowl arm 1500. Instead, the gyroid structure 1515 may only occupy a portion of the porous cowl arm 1500.

Further aspects of the present disclosure are provided by the subject matter of the following clauses.

A combustor for a turbomachine engine comprises a combustion chamber, and a component in operable flow with the combustion chamber and having a porous structure that defines a plurality of channels, the plurality of channels being adapted as a damper to reduce combustion dynamics of the combustor.

The combustor of the preceding clause, the component being one of a ferrule, a cowl, a dome, a swirler, and a liner.

The combustor of any preceding clause, the component being a first component, the plurality of channels is a first plurality of channels and the damper is a first damper, and the combustor further comprises a second component in operable flow with the combustion chamber and having a porous structure that defines a second plurality of channels, the second plurality of channels being adapted as a second damper to reduce combustion dynamics of the combustor, and herein second component being one of a ferrule, a cowl, a dome, and a liner.

The combustor of any preceding clause, the porous structure being one of a gyroid, a honeycomb, a triply periodic minimal surface (TPMS), and a degyroid.

The combustor of any preceding clause, the porous structure having a porosity between thirty percent and eighty percent, inclusive.

The combustor of any preceding clause, the combustion dynamics comprising at least one of mechanical vibrations, thermoacoustic instabilities, and hydrodynamic instabilities.

The combustor of any preceding clause, the damper reducing combustion dynamics of the combustor by at least one of increasing viscous dissipation and increasing heat dissipation.

The combustor of any preceding clause, the plurality of channels being characterized by a plurality of parameters, the plurality of parameters comprising at least one of a width, a length, a wall thickness, a shape, a curvature, and a cross section.

The combustor of any preceding clause, a first channel of the plurality of channels having a first length that is equal to a quarter wavelength of a first frequency of combustion dynamics, and a second channel of the plurality of channels having a second length that is equal to a quarter wavelength of a second frequency of combustion dynamics.

The combustor of any preceding clause, the shape being one of a linear shape, a curved shape, and a serpentine shape, and the cross section being one of circular, oval, square, rectangular, hexagonal, triangular, and gyroid.

The combustor of any preceding clause, the porous structure being made of a material, and a first channel of the plurality of channels has a first width that is at most four times a thermal penetration depth of the material at a first frequency of combustion dynamics, and a second channel of the plurality of channels having a second width that is at most four times a thermal penetration depth of the material at a second frequency of combustion dynamics.

The combustor of any preceding clause, the first frequency being two hundred Hertz, the first width being forty mils, the second frequency being one thousand Hertz, and the second width being eighteen mils.

The combustor of any preceding clause, the material being one of a metal alloy and a ceramic matrix composite.

The combustor of any preceding clause, the component being adapted to dampen combustion dynamics for a plurality of frequencies between one hundred eighty Hertz to two thousand Hertz, inclusive.

The combustor of any preceding clause, a first portion of the porous structure being adapted to dampen a first frequency of combustion dynamics, and a second portion of the porous structure is adapted to dampen a second frequency of combustion dynamics.

A combustor of a turbomachine engine comprises a diffuser, a combustor component positioned aft of the diffuser to receive cooling air therefrom, and a support structure being in operable flow with the diffuser and the combustor component and positioned therebetween, the support structure having a porous structure that defines a plurality of channels, the plurality of channels being adapted to improve a backflow margin of the cooling air by reducing turbulence of the cooling air.

The combustor of the preceding clause, the support structure being one of a mounting arm and a radial support arm.

The combustor of any preceding clause, the combustor component being one of a swirler, a ferrule, an inner liner, and an outer liner.

The combustor of any preceding clause, the porous structure being at least one of a plurality of holes, a plurality of slots, a lattice, a truss, a geodesic, and a gyroid.

The combustor of any preceding clause, at least a portion of the porous structure having a porosity between thirty percent and eighty percent, inclusive.

Although the foregoing description is directed to the preferred embodiments, other variations and modifications will be apparent to those skilled in the art, and may be made without departing from the spirit or the scope of the disclosure. Moreover, features described in connection with one embodiment may be used in conjunction with other embodiments, even if not explicitly stated above.

The invention claimed is:

1. A combustor for a turbomachine engine, the combustor having a longitudinal centerline axis and comprising:

a combustion chamber that combusts a fuel and air mixture, which generates combustion dynamics; and a component in operable flow with the combustion chamber and having a porous structure that defines a plurality of channels, the porous structure being a lattice including a plurality of longitudinal channels that are parallel with the longitudinal centerline axis of the combustor and a plurality of transverse channels that are orthogonal to the longitudinal centerline axis, wherein some of the transverse channels are radially outward of some of the longitudinal channels in the component and others of the transverse channels are radially inward of the some of the longitudinal channels in the component, and wherein the plurality of channels cause the component to act as a damper in order to reduce the combustion dynamics of the combustor.

2. The combustor of claim 1, wherein the component is one of a ferrule, a cowl, a dome, a swirler, or a liner.

3. The combustor of claim 1, wherein the component is a first component, the plurality of channels is a first plurality of channels and the damper is a first damper, and the combustor further comprises a second component in operable flow with the combustion chamber, the second component being one of a ferrule, a cowl, a dome, or a liner, and having a second porous structure, the second porous structure being one of a lattice, a gyroid, or a triply periodic minimal surface (TPMS), that defines a second plurality of channels, and the second plurality of channels are adapted as a second damper to reduce combustion dynamics of the combustor.

4. The combustor of claim 1, wherein the porous structure has a porosity between thirty percent and eighty percent, inclusive.

5. The combustor of claim 1, wherein the combustion dynamics comprise at least one of mechanical vibrations, thermoacoustic instabilities, or hydrodynamic instabilities.

6. The combustor of claim 1, wherein the damper reduces combustion dynamics of the combustor by at least one of increasing viscous dissipation or increasing heat dissipation.

7. The combustor of claim 1, wherein a first channel of the plurality of channels has a first length that is equal to a quarter wavelength of a first frequency of the combustion dynamics, and a second channel of the plurality of channels has a second length that is equal to a quarter wavelength of a second frequency of the combustion dynamics.

8. The combustor of claim 1, wherein the plurality of channels is characterized by a shape being one of a linear shape, a curved shape, or a serpentine shape.

9. The combustor of claim 1, wherein the porous structure is made of a material, and a first channel of the plurality of channels has a first width that is at most four times a thermal penetration depth of the material at a first frequency of the combustion dynamics, and a second channel of the plurality of channels has a second width that is at most four times a thermal penetration depth of the material at a second frequency of the combustion dynamics.

10. The combustor of claim 9, wherein the first frequency is two hundred Hertz, the first width is forty mils, the second frequency is one thousand Hertz, and the second width is eighteen mils.

11. The combustor of claim 9, wherein the material is one of a metal alloy or a ceramic matrix composite.

12. The combustor of claim 1, wherein the component is adapted to dampen combustion dynamics for a plurality of frequencies between one hundred eighty Hertz to two thousand Hertz, inclusive.

13. The combustor of claim 12, wherein a first portion of the porous structure is adapted to dampen a first frequency of the combustion dynamics, and a second portion of the porous structure is adapted to dampen a second frequency of the combustion dynamics.

14. The combustor of claim 1, wherein the plurality of channels is characterized by a cross section being one of a circular, oval, square, rectangular, hexagonal, triangular, or gyroid cross section.

15. A combustor for a turbomachine engine, the combustor having a longitudinal centerline axis and comprising:

a combustion chamber that combusts a fuel and air mixture, which generates combustion dynamics;

a diffuser;

a combustor component positioned aft of the diffuser to receive a flow of cooling air therefrom, the flow of cooling air having turbulence and a backflow margin; and a support structure being in operable flow with the diffuser and the combustor component and positioned therebetween, wherein the combustor component has a porous structure that defines a plurality of channels, the porous structure being a lattice including a plurality of longitudinal channels that are parallel with the longitudinal centerline axis of the combustor and a plurality of transverse channels that are orthogonal to the longitudinal centerline axis, wherein some of the transverse channels are radially outward of some of the longitudinal channels in the combustor component and others of the transverse channels are radially inward of the some of the longitudinal channels in the combustor component, and wherein the plurality of channels cause the combustor component to act as a damper in order to reduce the combustion dynamics of the combustor.

16. The combustor of claim 15, wherein the support structure is one of a mounting arm or a radial support arm.

17. The combustor of claim 15, wherein the combustor component is one of a swirler, a ferrule, an inner liner, or an outer liner.

18. The combustor of claim 15, wherein at least a portion of the porous structure has a porosity between thirty percent and eighty percent, inclusive.

19. The combustor of claim 15, wherein the damper reduces combustion dynamics of the combustor by at least one of increasing viscous dissipation or increasing heat dissipation.

20. The combustor of claim 15, wherein the porous structure is made of a material, and a first channel of the plurality of channels has a first width that is at most four times a thermal penetration depth of the material at a first frequency of the combustion dynamics, and a second channel of the plurality of channels has a second width that is at most four times a thermal penetration depth of the material at a second frequency of the combustion dynamics.

* * * * *